US007697881B2

(12) United States Patent
Hayashi et al.

(10) Patent No.: US 7,697,881 B2
(45) Date of Patent: Apr. 13, 2010

(54) IMAGE FORMING APPARATUS

(75) Inventors: Yasuhiro Hayashi, Moriya (JP); Daigo Matsuura, Toride (JP); Ikuo Nakamoto, Toride (JP); Kazuhiro Hasegawa, Toride (JP); Shigeaki Takada, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 11/374,199

(22) Filed: Mar. 14, 2006

(65) Prior Publication Data

US 2006/0210288 A1 Sep. 21, 2006

(30) Foreign Application Priority Data

Mar. 17, 2005 (JP) ..... 2005-077511
Sep. 13, 2005 (JP) ..... 2005-265512

(51) Int. Cl.
*G03G 15/20* (2006.01)

(52) U.S. Cl. ..... 399/399

(58) Field of Classification Search ..... 399/33
See application file for complete search history.

(56) References Cited

U.S. PATENT DOCUMENTS

| | | | | |
|---|---|---|---|---|
| 7,146,116 | B2 * | 12/2006 | Nonaka et al. | 399/33 |
| 2004/0101334 | A1 | 5/2004 | Tatematsu et al. | 399/329 |
| 2004/0240898 | A1 * | 12/2004 | Nonaka et al. | 399/33 |
| 2005/0031364 | A1 | 2/2005 | Hayashi | 399/69 |
| 2006/0140663 | A1 | 6/2006 | Matsuura | 399/96 |

FOREIGN PATENT DOCUMENTS

| | | |
|---|---|---|
| CN | 1501198 A | 6/2004 |
| JP | 10-39676 | 2/1998 |

(Continued)

OTHER PUBLICATIONS

English abstract and JPO Machine Translation of Yokota (JP 2001-250670 A).*

(Continued)

*Primary Examiner*—David M Gray
*Assistant Examiner*—Erika Villaluna
(74) *Attorney, Agent, or Firm*—Fitzpatrick, Cella, Harper & Scinto

(57) ABSTRACT

An image heating apparatus includes an endless belt for heating an image on a recording material; a plurality of supporting members on which the belt is trained; magnetic flux generating means, disposed outside of the belt, for generating heat in the belt by a magnetic flux, the magnetic flux generating means being effective to cause induction heating both in a region of the belt between the supporting members and in at least one of the regions of the belt trained on the supporting members; a temperature detecting element for detecting a temperature of the belt in the region between the supporting members at a position across the belt from the magnetic flux generating means; and electric power supply shut-off means for shutting off electric power supply to the magnetic flux generating means on the basis of an output of the temperature detecting element.

19 Claims, 19 Drawing Sheets

FOREIGN PATENT DOCUMENTS

| | | | |
|---|---|---|---|
| JP | 2001117412 A | * | 4/2001 |
| JP | 2001-250670 | | 9/2001 |
| JP | 2001-313161 | | 11/2001 |
| JP | 2002-108123 | | 4/2002 |

OTHER PUBLICATIONS

Official Letter in English issued on Dec. 27, 2007, by the European Patent Office, in Application No. 06 111 259.5.

Official Letter (English Translation)/Search Report, issued by The Patent Office of the People's Republic of China, on Mar. 7, 2008, in Chinese Application No. 200610067605.8.

Official Letter (English Translation)/Search Report, dated Jan. 14, 2009, issued by the European Patent Office, in European Application No. 06111259.5.

* cited by examiner

IMAGE FORMING APPARATUS

FIELD OF THE INVENTION AND RELATED ART

The present invention relates to an image heating apparatus which uses a heating method based on electromagnetic induction to heat the image on a recording medium. An image heating apparatus in accordance with the present invention can be used as a fixing apparatus mounted in an image forming apparatus such as a copying machine or printer to fix the image on a recording medium, or a glossiness increasing apparatus for increasing in glossiness the image temporality fixed to recording medium.

As a fixing apparatus employed by an electrophotographic image forming apparatus to thermally fix an unfixed toner image, there have been proposed many apparatuses different in heating method.

Among them, the heating apparatuses employing a heating method based on electromagnetic induction, which directly heats a heating member of the heating apparatus (fixing apparatus) have been attracting attention from the standpoint of energy conservation.

As an example of a fixing apparatus using this heating method based on electromagnetic induction (which hereinafter may be referred to as inductive heating method), an image heating apparatus is disclosed in Japanese Laid-open Patent Application 2002-108123, which employs a fixation roller as an object to be heated by electromagnetic induction. Also disclosed in this application is a structural arrangement for preventing a heat member from overheating as the heating apparatus goes out of control. More specifically, a thermal switch is disposed in the heating area, in which a magnetic flux generating means opposes the heating member (which in this case is a heat roller), with the fixation roller being between the thermal switch and magnetic flux generating means.

As another example of the fixing apparatus employing the heating method based on electromagnetic induction, Japanese Laid-open Patent Application 2001-250670 discloses a fixing apparatus which employs a heating member in the form of a belt in order to reduce the heating member in thermal capacity. Also in this fixing apparatus, an excitation coil is disposed so that it straddles the area between one end of the belt loop, where the belt is suspended by a belt suspending member, and the other end of the belt loop, where the belt is suspended by another belt suspending member (FIG. 2).

This fixing apparatuses is structured so that heat is directly generated in the fixation belt itself. Therefore, the fixation belt can be increased faster in temperature to a preset fixation temperature level than a fixation roller. In other words, this fixing apparatus is advantageous in that its fixation belt used for fixing the image formed on a recording medium is superior in thermal responsiveness.

Further, the fixing apparatus is structured so that its coil straddles the area between one end of the belt loop, where the belt is suspended by one of belt suspending members, and the other end of the belt loop, where the belt is suspended by the other belt suspending member. Therefore, even if the fixing apparatus is reduced in size, it is possible to secure a wide belt heating area, making it therefore possible to increase the speed at which the fixing apparatus increases in temperature. Therefore, it is possible to reduce the fixing apparatus in warmup time.

However, a structural design for a fixing apparatus, such as the one disclosed in Japanese Laid-open Patent Application 2001-250670, which disposes the coil so that it straddle the area between one end of the belt loop, where the belt is suspended by a belt suspending member, and the other end of the belt loop, where the belt is suspended by another belt suspending member, suffers from the following problems. That is, in this design, a thermistor for detecting the belt temperature is disposed in the adjacencies of the belt nip. Therefore, the temperature of the heat generation area in which the belt and coil oppose each other cannot be detected. Therefore, should the fixing apparatus go out of control, a substantial length of time would elapse before the abnormal belt temperature is detected.

Moreover, should the electric power supply to the coil go out of control while the fixation belt is not rotated, the portion of the belt, which is opposing the coil, abnormally increases in temperature, sustaining therefore thermal damages, before the abnormal temperature is detected.

Further, in the case of a fixing apparatus, the coil of which is disposed so that it straddle the area between one end of the belt loop, where the belt is suspended by one of belt suspending members, and the other end of the belt loop, where the belt is suspended by the other belt suspending member, the difference in thermal capacity between the belt supporting members renders the belt nonuniform in apparent thermal capacity in terms of the circumferential direction of the belt (FIG. 2). Therefore, simply placing a thermo-switch in the area, in which heat is generated in the belt, is not enough to suppress, in its early stage, the excessive temperature increase which occurs to the belt due to an anomaly. In other words, there is still much to be discussed regarding the measures for making a fixing apparatus safer.

Also in order to prevent the fixation belt from sustaining thermal damages, it is possible to employ, in place of the temperature detection element, a thermo-switch or the like, as a means for interrupting the power supply as soon as an anomaly occurs, and setting the actuation temperature of the thermo-switch or the like to a relatively low level. In the case of this measure, however, the thermo-switch is liable to erroneously responds during a normal image fixing operation; it is liable to react even when the amount by which the temperature of the fixation belt has increased beyond the target temperature is very small.

In other words, placing a thermo-switch or the like as described above cannot truly guarantee a fixing apparatus in terms of safety.

SUMMARY OF THE INVENTION

Thus, the primary object of the present invention is to provide an image heating apparatus, the coil of which straddles the area between one end of the belt loop, where the belt is suspended by one of belt suspending members, and the other end of the belt loop, where the belt is suspended by the other belt suspending member, and which is characterized in that it can suppress in its early stage, the excessive increase in the belt temperature attributable to an anomaly, being therefore very safe.

According to an aspect of the present invention, there is provided an image heating apparatus comprising an endless belt for heating an image on a recording material; a plurality of supporting members on which said belt is trained; magnetic flux generating means, disposed outside of said belt, for generating heat in said belt by a magnetic flux, said magnetic flux generating means being effective to cause induction heating both in a region of said belt between said supporting members and in at least one of the regions of said belt trained on said supporting members; a temperature detecting element for detecting a temperature of said belt in the region between said supporting members at a position across said belt from said magnetic flux generating means; and electric power supply shut-off means for shutting off electric power supply to said magnetic flux generating means on the basis of an output of said temperature detecting element.

According to another aspect of the present invention, there is provided an image heating apparatus comprising an endless belt for heating an image on a recording material; a plurality of supporting members on which said belt is trained; magnetic flux generating means, disposed outside of said belt, for generating heat in said belt by a magnetic flux, said magnetic flux generating means being effective to generate heat both in a region of said belt between said supporting members and in at least one of the regions of said belt trained on said supporting members; a shut-off element for shutting of electric power supply to said magnetic flux generating means when a temperature of said belt becomes abnormal, wherein said shut-off element is disposed, in contact to said belt or in a small space therebetween, at a position which is opposed to said magnetic flux generating means with said belt therebetween and which is between said supporting members.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be concretely described with reference to the embodiments of the present invention. Incidentally, although these embodiments are some of the most preferable embodiments of the present invention, they are not intended to limit the scope of the present invention.

Embodiment 1

(1) Example of Image Forming Apparatus

Figure 1:
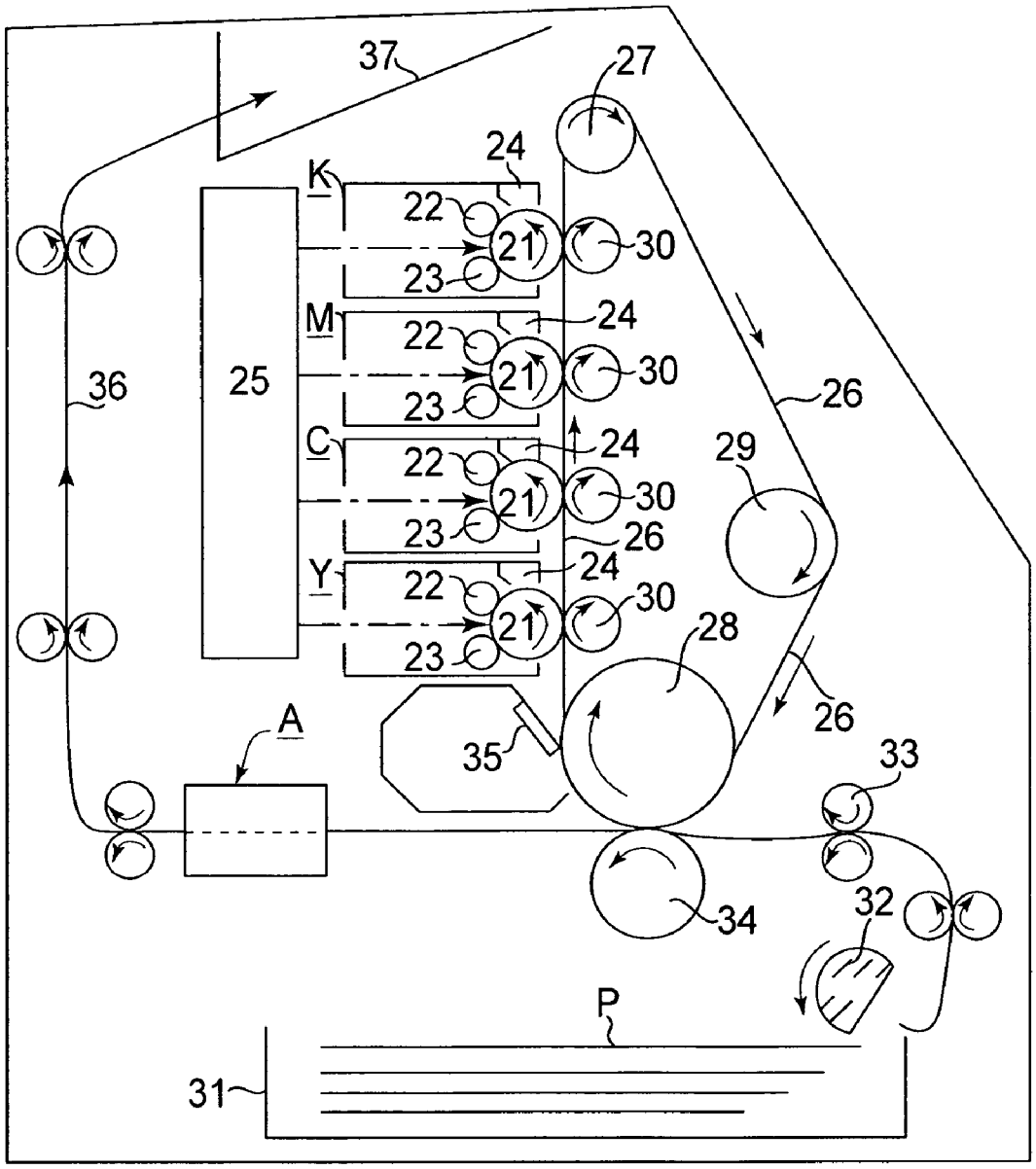
FIG. 1 is a schematic drawing of the image forming apparatus in the first embodiment, showing the general structure thereof.

FIG. 1 is a schematic drawing of an example of an image forming apparatus in which an image heating apparatus in accordance with the present invention is mounted as a fixing apparatus, showing the general structure thereof. This image forming apparatus is an electrophotographic color image forming apparatus.

Designated by referential symbols Y, C, M, and K are four image forming portions which form yellow, cyan, magenta, and black toner images, respectively. The four image forming portions are vertically stacked in the listed order starting from the bottom. Each of the four image forming portions Y, C, M, and K has a photosensitive drum 21, a charging apparatus 22, a developing apparatus 23, a cleaning apparatus 24, etc.

In the developing apparatus 23 of the yellow image forming portion Y, yellow toner is stored, and in the developing apparatus 23 of the cyan image forming portion C, cyan toner is stored. In the developing apparatus 23 of the magenta image forming portion C, magenta toner is stored, and in the developing apparatus 23 of the black image forming portion K, black toner is stored.

Further, the image forming apparatus is also provided with an optical system 25 for forming an electrostatic latent image by exposing the photosensitive drum 21. The optical system 25 is disposed so that it opposes the four image forming portions Y, C, M, and K. The optical system in this embodiment is a laser scanner.

In each of the image forming portions Y, C, M, and K, the photosensitive drum 21 is uniformly charged by the charging apparatus 22, and then, the charged photosensitive drum 21 is exposed by the optical system 25; it is scanned by a beam of light projected from the optical system while being modulated with image formation data. As a result, an electrostatic latent image, which reflects the image formation data, is formed on the peripheral surface of the photosensitive drum 21.

The electrostatic latent image is developed by the developing apparatus 23, into a visible image (image formed of toner, and hereinafter will be referred to simply as toner image). In other words, on the photosensitive drum 21 in the yellow image forming portion Y, a visible image is formed of yellow toner, and on the photosensitive drum 21 in the cyan image forming portion C, a visible image is formed of cyan toner. On the photosensitive drum 21 in the magenta image forming portion M, a visible image is formed of magenta toner, and on the photosensitive drum 21 in the black image forming portion K, a visible image is formed of black toner.

The image formed of color toner, on the photosensitive drum 21 in each of the image forming portions Y, C, M, and K is sequentially transferred (primary transferred) in layers onto a preset location of an intermediary transfer medium 26, in synchronism with the rotation of the photosensitive drum 21, while the intermediary transfer medium 26 is rotated at roughly the same peripheral velocity as the photosensitive drum 21. As a result, a single unfixed full-color toner image is synthetically formed on the intermediary transfer medium 26. In this embodiment, an endless belt is employed as the intermediary transfer medium 26, which is stretched around three rollers, that is, a driver roller 27, a belt backing roller 28 (roller disposed against secondary transfer roller to back intermediary transfer medium 26), and a tension roller 29, being thereby suspended by the three rollers. The intermediary transfer medium 26 is driven by the driver roller 27.

As the primary transferring means for transferring (primary transfer) a toner image from the peripheral surface of the photosensitive drum 21 in each of the image forming portions Y, C, M, and K, onto the intermediary transfer belt 26, a primary transfer roller 30 is employed. To the primary transfer roller 30, a primary transfer bias, which is opposite in polarity to that of the toner, is applied from an unshown bias application power source. As a result, the toner image is transferred (primary transfer) from the peripheral surface of the photosensitive drum 21 in each of the image forming portions Y, C, M, and K, onto the intermediary transfer belt 26. After the transfer (primary transfer) of the toner image onto the intermediary transfer belt 26 from each of the image forming portions Y, C, M, and K, the residual toner, that is, the toner remaining on the photosensitive drum 21 after the transfer, is removed by the cleaning apparatus 24.

The above described steps are carried out for each of the yellow, magenta, cyan, and black colors, in synchronism with the rotation of the intermediary transfer belt 26, whereby toner images are sequentially transferred (primary transferred) in layers onto the intermediary transfer belt 26. Incidentally, when it is desired to form a monochromatic image (when image forming apparatus is in monochromatic mode), the above described steps are carried out only for the desired color.

Meanwhile, recording mediums P in a recording medium cassette 31 are fed, while being separated one by one, by a feed roller 32 into the main assembly of the image forming apparatus, and each recording medium P is delivered to a pair of registration rollers 33. Then, the recording medium P is delivered, with a preset timing, by the registration rollers 33 to a transfer nip, that is, the pressure nip formed between the portion of the intermediary transfer belt 26, which is wrapped halfway around the belt backing roller 28, and the secondary transfer roller.

The four monochromatic toner images on the intermediary transfer belt 26, which have synthetically formed the single full-color image on the intermediary transfer belt 26 by being sequentially transferred (primary transfer) onto the intermediary transfer belt 26, are transferred (secondary transfer) all at once onto the recording medium P by the bias which is opposite in polarity to the toner and is applied to the secondary transfer roller 34 from an unshown bias application power source. The secondary residual toner, that is, the toner remaining on the intermediary transfer belt 26 after the secondary transfer, is removed by a cleaning apparatus 35 for cleaning the intermediary transfer belt 26.

The toner images having transferred (secondary transfer) onto the recording medium P are fixed to the recording medium P by a fixing apparatus A, which is an image heating apparatus; the toner particles in the toner images are fused to the recording medium P, while being mixed, by being melted. Thereafter, the recording medium P is discharged as a full-color print into a delivery tray 37 through a paper discharge path 36.

(2) Fixing Apparatus A

In the description of the fixing apparatus A, which will be given next, the lengthwise direction of the fixing apparatus A and the structural components of the fixing apparatus A means the direction parallel to the direction perpendicular to the direction in which recording medium P is conveyed through the recording medium conveyance path (which hereinafter will be referred to simply as recording medium conveyance direction). The widthwise direction of the fixing apparatus A and the structural components of the fixing apparatus A means the direction parallel to the abovementioned recording medium conveyance direction. Further, the front surface of the fixing apparatus A means the surface of the fixing apparatus A as seen from the recording medium entrance side, and the rear surface of the fixing apparatus A means the surface opposite to the front surface (surface on the recording medium exit side). The left and right sides of the fixing apparatus A means the left and right sides as seen from the front side of the apparatus. The upstream and downstream sides of the fixing apparatus means the upstream and downstream sides in terms of the abovementioned recording medium conveyance direction.

Figure 2:
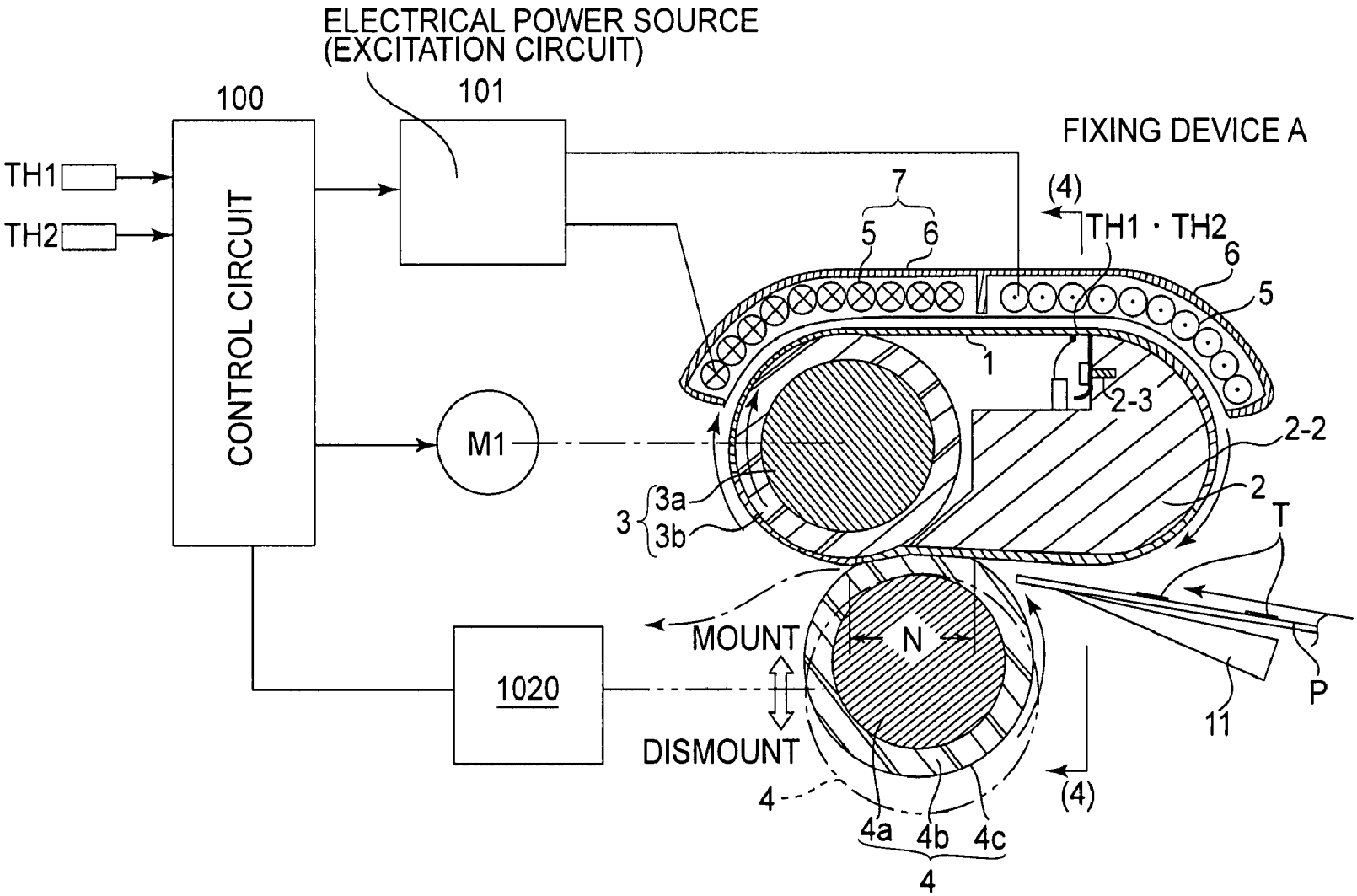
FIG. 2 is a combination of an enlarged sectional view of the essential portions of the fixing apparatus, and a block diagram of the control system, in the first embodiment.
Figure 3:
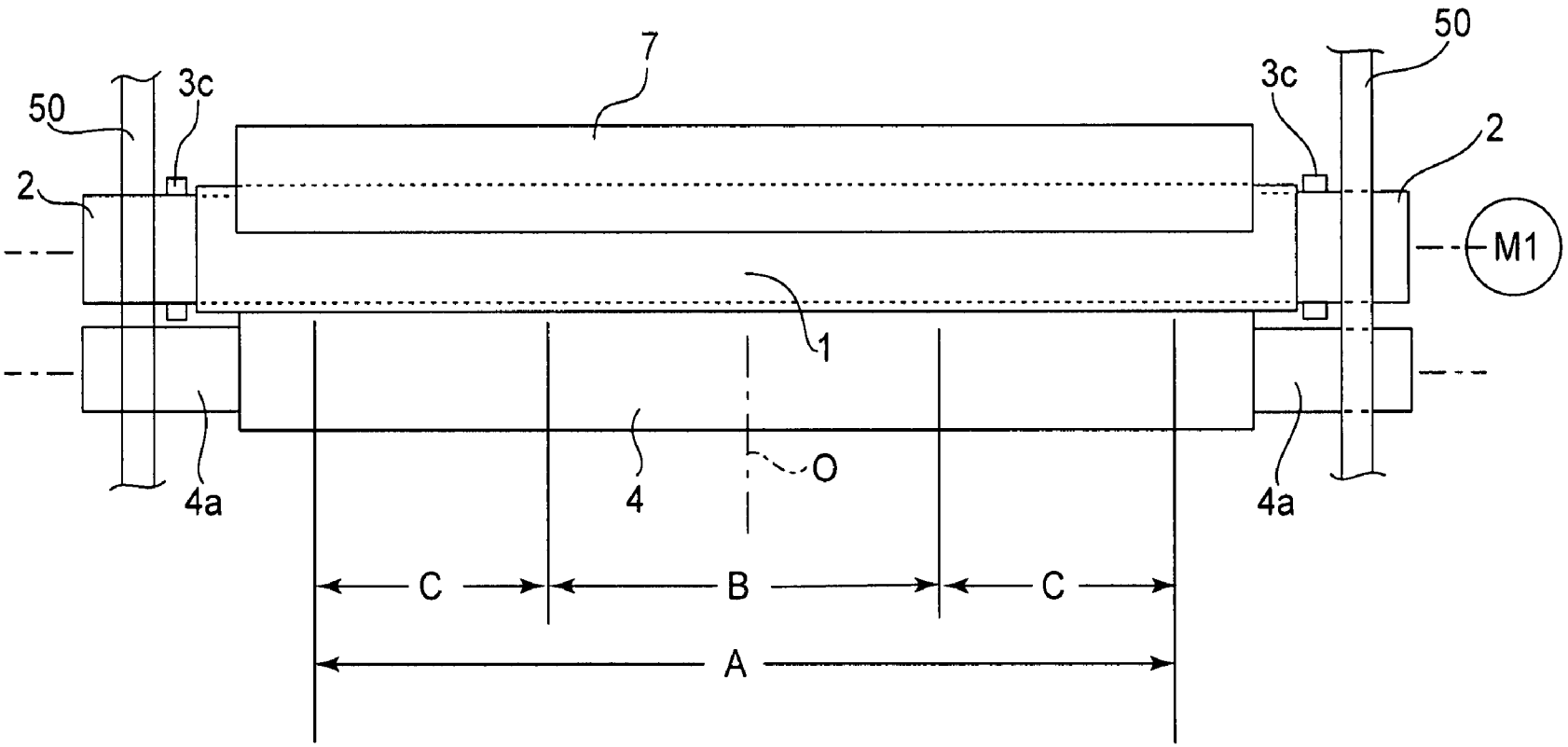
FIG. 3 is a front view of the fixing apparatus in the first embodiment.
Figure 4:
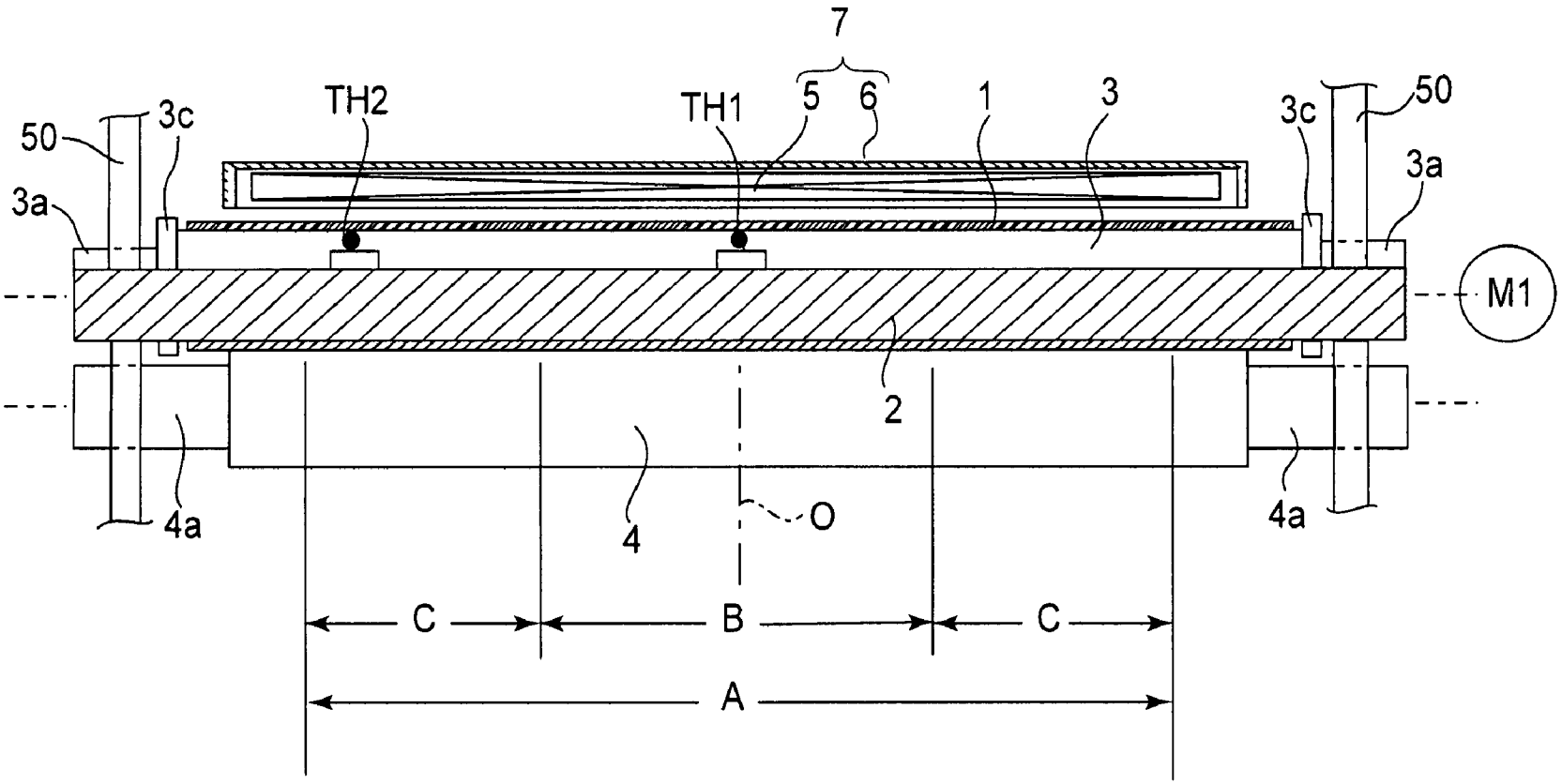
FIG. 4 is a vertical sectional view of the fixing apparatus in the first embodiment, at line (4)-(4) in FIG. 2.
Figure 5:
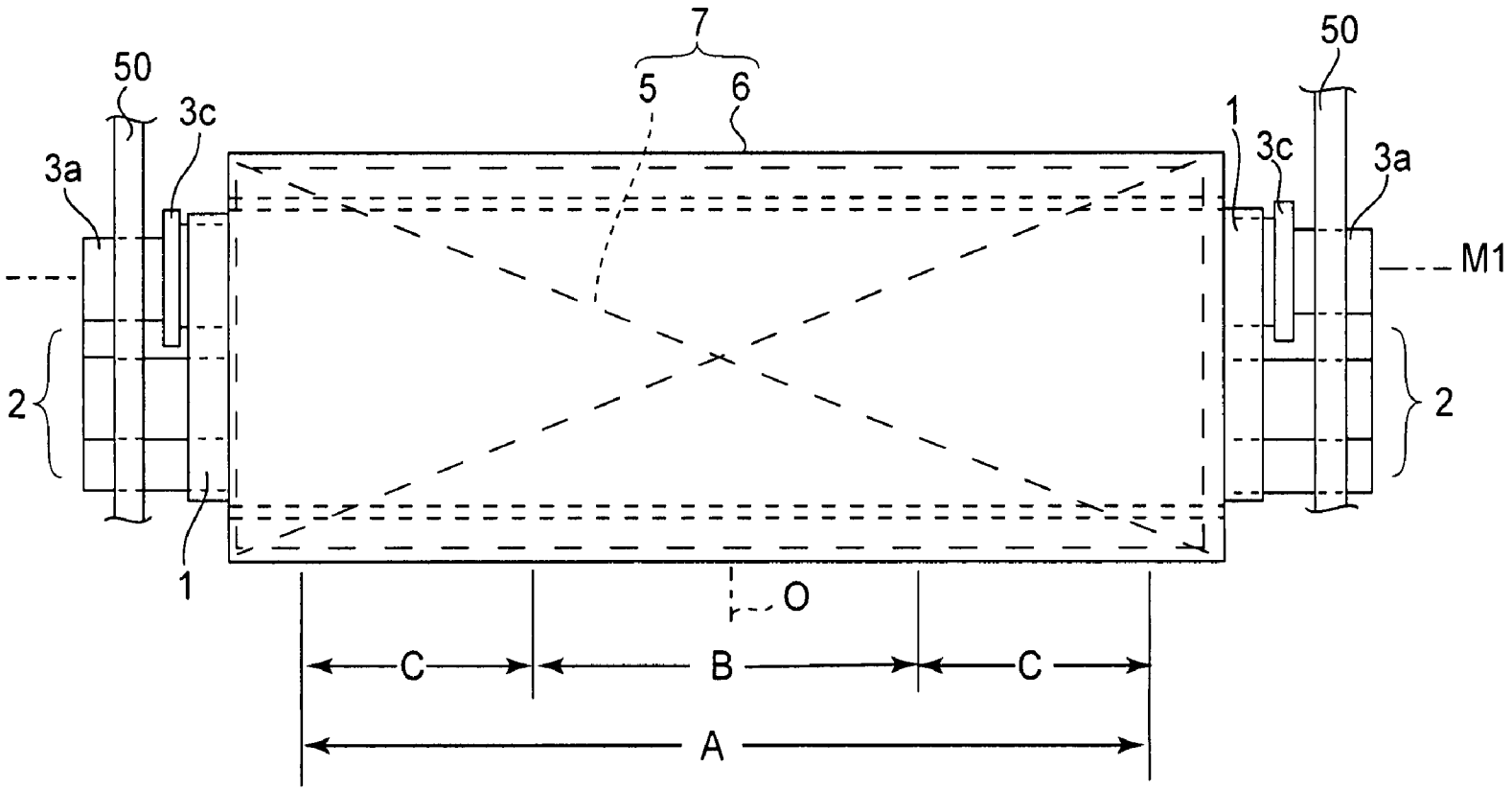
FIG. 5 is a plan view of the fixing apparatus.

FIG. 2 is a combination of an enlarged sectional view of the essential portions of the fixing apparatus A as an image heating apparatus A, and a block diagram of the control system therefor. FIG. 3 is a front view of the fixing apparatus A. FIG. 4 is a vertical sectional view of the fixing apparatus A, at line (4)-(4) in FIG. 2. FIG. 5 is a plan view of the fixing apparatus A.

Designated by a referential symbol 1 is a flexible fixing belt in the form of an endless belt, which has a metallic layer. Designated by referential symbols 2 and 3 are a belt guide, which is a belt suspending-supporting member disposed in the loop of the fixation belt 1 to support the belt 1, and a fixation roller disposed also in the loop, respectively.

The fixation roller 3 is rotatably supported between the left and right lateral plates 50 of the fixating apparatus frame, by bearings (unshown) attached to the left and right plates, respectively.

The belt guide 2 is nonrotatably supported between the lateral plates 50, in parallel to the fixation roller 3; the belt guide 2 is a stationary member.

As described above, the fixation belt 1 is stretched around the belt guide 2 and fixation roller 3, being suspended by them. The belt guide 2 also functions as a tension providing member, which is rendered movable by a pressing member (unshown) in the direction to be moved away from the fixation roller 3.

With the provision of this structural arrangement, the fixation belt 1 is supported between the belt guide 2 and fixation roller 3 while remaining tightly stretched.

Designated by a referential symbol 4 is a pressure roller, which is a rotatable member for pressure application. This pressure roller 4 is disposed under the fixation roller 2, in parallel to the fixation roller 2. It is rotatably supported between the left and right lateral plates 50, by a pair of bearings (unshown) attached to the lateral plates 50, one for one. The pressure roller 4 is kept pressed upward by a pressing means (unshown), with the application of a preset amount of pressure. Thus, a pressure nip N (fixation nip) having a width (in terms of above described widthwise direction) of a preset value is formed between the fixation roller 3 and pressure roller 4, with the fixation belt 1 sandwiched between the downward facing portion of the fixation roller 3, and the pressure roller 4, and between the downwardly facing surface of the belt guide 2, which extends toward the fixation roller 3. Incidentally, the downwardly facing surface of the belt guide 2 is flat between its curved portion and the pressure nip N.

Designated by a referential symbol 7 is an excitation unit as a heat generation source (magnetic flux generating means) for generating heat in the fixation belt 1 by electromagnetic induction. The excitation unit 7 is disposed on the upstream side of the fixation nip N. The excitation unit 7 is shaped like an elongated piece of thin plate, and is made up of a coil 5 (excitation coil) for electromagnetic induction, and a magnetic core 6. The coil 5 is formed of electrical wire, more specifically, Litz wire, which is wound in a flat and elongated shape, the major axis of which is parallel to the lengthwise direction of the fixing apparatus. The magnetic core 6 is disposed in a manner to cover the induction coil 5 to prevent the magnetic field generated by the induction coil 5 from leaking, except toward the metallic layer (electrically conductive layer) of the fixation belt 1. The induction coil 5 and magnetic core 6 are attached to each other with the use of an electrically nonconductive resin, as if the coil 5 were buried in the resin held in the recess formed by the magnetic core 6.

The excitation unit 7 is disposed on the top side of the fixation belt loop, in a manner to straddle the fixation roller 3 and belt guide 2 as the belt supporting members, with the provision of a preset amount of gap between the fixation belt 1 and excitation unit 7. The excitation unit 7 is rigidly supported by the lateral plates 50, with the brackets (unshown) or the like interposed between the excitation unit 7 and lateral plates 50.

With the excitation unit 7 disposed, as described above, so that the excitation unit 7 straddles both the first area (area between fixation roller 3 and belt guide 2) in which the excitation unit 7 opposes only the fixation belt 1, and the second area in which the excitation unit 7 opposes both of the fixation belt supporting members (fixation roller 3 and belt guide 2), not only is it possible to thoroughly heat the fixation belt 1, but also, reduce the fixing apparatus in warmup time, and improve the apparatus in image formation productivity.

Further, in this embodiment, the fixing apparatus is structured so that a given point of the fixation belt 1 in terms of the circumferential direction of the fixation belt 1 moves past the first area, second area, and fixation nip, in the listed order. Therefore, even if the fixation belt 1 is nonuniformly heated because the distance between the coil 5 and fixation belt 1 is varied by the fluttering or the like of the fixation belt 1 in the first area, the resultant nonuniformity in heat distribution of the fixation belt 1 can be overcome through the heat generation in the fixation belt 1, in the second area in which the fixation belt 1 does not flutter.

Hereinafter, the "path width" of a recording medium means the measurement of the recording medium in terms of the direction perpendicular to the recording medium conveyance direction. The length (dimension in width direction of recording medium) of the fixation belt 1 is rendered greater than the path width A of a recording medium P with the largest path width (which hereinafter may be referred to as large recording medium, for simplicity). The length (dimension in path width direction of recording medium) of the induction coil 5 of the excitation unit 7 is also rendered greater than the path width A. The image forming apparatus in this embodiment is designed so that while the recording medium P is conveyed through the apparatus, it is controlled so that, in terms of its width direction, its centerline coincides with the centerline of the recording medium passage of the image forming apparatus. Designated by a referential symbol O is the referential center line (theoretical line), and designated by a referential symbol B is the path width (recording medium passage) of a recording medium of the small size (which hereinafter may be referred to as small recording medium, for simplicity). Further, designated by a referential symbol C is the portion of the path width A, which is outside the path width of the small recording medium.

While the fixation belt 1 is rotated (circularly moved), high frequency current, the frequency of which is in the range of 20-50 kHz is flowed to the induction coil 5 of the excitation unit 7 from an electrical power source 101 (excitation circuit). Thus, heat is generated in the metallic layer (electrically conductive layer) of the fixation belt 1 by the magnetic field generated by the induction coil 5. That is, the fixation belt 1 is heated by electromagnetic induction.

Referring to FIG. 4, designated by a referential symbol TH1 is a first temperature sensor (temperature detection element) such as a thermistor, which is disposed so that it faces the coil 5 without the presence of the belt guide 2 between the first temperature sensor TH1 and coil 5; it is within the loop of the fixation belt 1, and it contacts the center of the fixation belt 1 in terms of the widthwise direction of the fixation belt 1.

This first temperature sensor TH1 detects the temperature of the portion of the fixation belt 1, which is within the area which is within the path width of the recording medium regardless of whether the large or small recording medium is conveyed through the fixing apparatus. The temperature data detected by the first temperature sensor TH1 is fed back to a control circuit 100, which controls the amount of electric power inputted to the induction coil 5 from the electric power source 101, so that the detected temperature level inputted to the control circuit 100 from the first temperature sensor TH1 is kept at a preset target temperature level (fixation temperature). More specifically, as the detected temperature of the fixation belt 1 rises to the preset level, the power supply to the induction coil 5 is cut off. In this embodiment, the temperature of the fixation belt 1 is adjusted by controlling the amount of electric power inputted to the induction coil 5, by varying in frequency the high frequency current, based on the temperature level detected by the first temperature sensor TH1.

Referring also to FIG. 4, designated by a referential symbol TH2 is a second temperature sensor (temperature detection element), which is disposed so that it faces the coil 5 without the presence of the belt guide 2 between the second temperature sensor TH2 and coil 5; it is within the loop of the fixation belt 1; and it contacts one of the edge portions of the fixation belt 1, that is, a point of the fixation belt 1 which is outside the recording medium footprint, in terms of the widthwise direction of the fixation belt 1. The temperature data of the edge portion of the fixation belt 1 obtained by the second temperature sensor TH2 are fed back to the control circuit 100.

The above described two temperature sensors, namely, the first and second temperature sensor TH1 and TH2, are attached to the belt guide 2 with an elastic supporting member interposed between the belt guide 2 and each temperature sensor. They are placed in contact with the portions of the inward surface of the fixation belt 1, which are largest in the amount of heat generation by the induction coil 5. They detect the temperature of the portions to which they are attached. The temperature sensors TH1 and TH2 are structured so that even if the portions of the fixation belt 1, with which the temperature sensors TH1 and TH2 are in contact, change in position because of the fluttering or the like of the fixation belt 1, they remain in contact with the fixation belt 1 by being caused to follow the movement of the fixation belt 1 by the abovementioned elastic supporting members; they are kept in contact with the fixation belt 1 by the elastic supporting members. At least while an image is actually formed, the fixation roller 3 is rotationally driven by a motor M1 (driving means), which is controlled by the control circuit 100, whereby the fixation belt 1 is circularly driven by the fixation roller 3 in the counterclockwise direction indicated by an arrow mark in FIG. 2, at a preset peripheral velocity, which is virtually the same velocity at which the recording medium P bearing an unfixed toner image T is conveyed toward the fixation belt 1 from the image transfer portion, so that the fixation belt 1 is circularly moved without being wrinkled. In this embodiment, the fixation belt 1 is circularly moved at a peripheral velocity of 160 mm/sec, making it possible for the fixing apparatus to fix 40 copies of A4 size per minute.

As the induction coil 5 of the excitation unit 7 begins to be supplied with the electric power from the power supplying apparatus 101, which is under the control of the control circuit 100, the fixation belt 1 is increased in temperature to a preset fixation temperature, at which the temperature of the fixation belt 1 is maintained. While the temperature of the fixation belt 1 is maintained at the preset fixation temperature, the recording medium P bearing an unfixed toner image T is guided by the guide 11, into the fixation nip N, more specifically, the contact area between the fixation belt 1 and pressure roller 4, with the image bearing surface of the recording medium P facing the fixation belt 1. Then, the recording medium P is conveyed, along with the fixation belt 1, through the fixation nip N while remaining pinched by the fixation belt 1 and pressure roller 4, being thereby tightly pressed upon the outward surface of the fixation belt 1. Thus, while the recording medium P is conveyed through the fixation nip N, it is given heat, primarily, the heat from the fixation belt 1, and also, is subjected to the compressive pressure of the fixation nip N (compression nip). As a result, the unfixed toner image on the recording medium P is fixed to the surface of the recording medium P by heat and pressure. As the recording medium P is conveyed out of the compression nip N, the recording medium P automatically separates itself from the outward surface of the fixation belt 1 because the surface of the fixation belt 1 deforms at the exit portion of the fixation nip N. Then, the recording medium P is conveyed out of the fixing apparatus.

1) Fixation Belt 1

Figure 6:
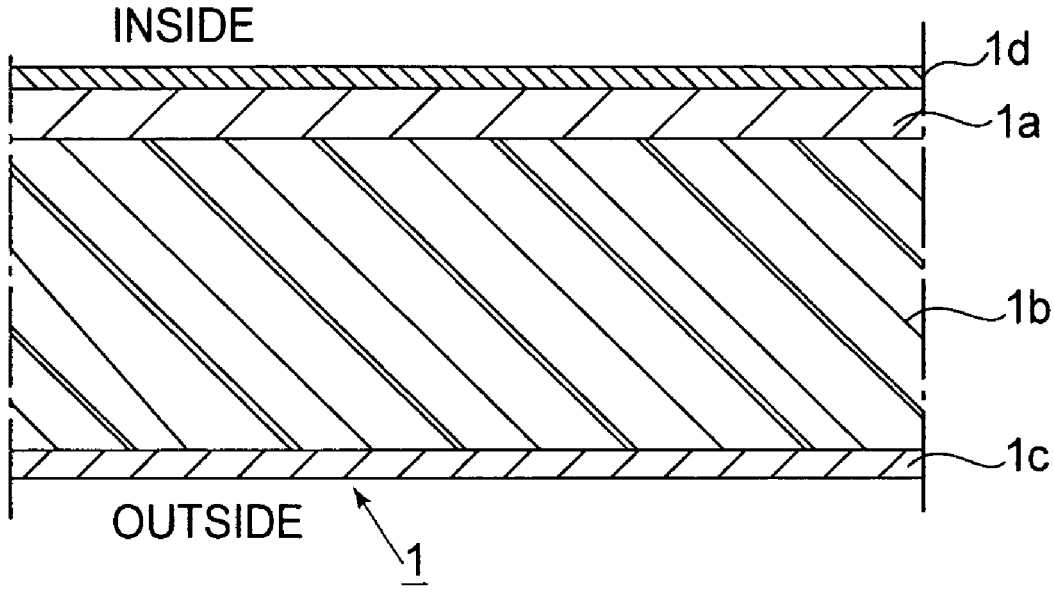
FIG. 6 is a schematic sectional view of the fixation belt, showing the laminar structure thereof.

FIG. 6 is a schematic sectional view of the fixation belt 1, showing the laminar structure thereof. The fixation belt 1 has a substrate layer 1*a* (metallic layer), which is 34 mm in internal diameter. The substrate layer 1*a* is formed of nickel by electrical casting, and is 50 μm in thickness.

The fixation belt 1 also has an elastic layer 1*b*, which is layered on the outward surface (in terms of loop which fixation belt forms) of the substrate layer 1*a*. The elastic layer 1*b* is formed of heat resistant silicone rubber. The thickness of the silicone rubber layer is desired to be in the range of 100-1,000 μm. In this embodiment, the thickness of the silicone rubber layer is made to be 30 μm, in consideration of the objective of reducing the fixing apparatus in warmup time by reducing the fixation belt 1 in thermal capacity, and the objective of satisfactorily fixing a color image. The silicone rubber as the material for this silicone rubber layer 1*b* is 20 degrees in JIS-A hardness scale, and 0.8 W/mK in thermal conductivity.

The fixation belt 1 also has a release layer 1*c* as the surface layer, which is layered on the outward surface of the elastic layer 1*b*. The release layer 1*c* is formed of fluorinated resin (for example, PFA or PTF), and is 30 μm in thickness.

Further, for the purpose of reducing the fixation belt 1 in the friction between the fixation belt 1 and any of the components located inside the loop of the fixation belt 1, a 10-50 μm thick layer 1*d* (slippery layer) of such resin as fluorinated resin, polyimide, or the like, may be placed on the inward surface of the substrate layer 1*a*. In this embodiment, a 20 μm thick polyimide layer is provided as this layer 1*d*.

If any of the components to be disposed within the loop of the fixation belt 1 is electrically conductive, the most inward layer of the fixation belt 1 is desired to be electrically non-conductive so that electric current is efficiently induced in the metallic substrate layer 1*a* of the fixation belt 1.

As the materials for the metallic layer 1*a* of the fixation belt 1, iron alloy, copper, silver, or the like, may be selected as fits, instead of nickel. Further, the metallic layer 1*a* may be formed by depositing the selected metal on a substrate layer formed of resin. The thickness of the metallic layer 1*a* may be adjusted according to the frequency of the high frequency current flowed through the induction coil 5, and the permeability and electrical conductivity of the material for the metallic layer 1*a*, which will be described later. The thickness of the metallic layer 1*a* is desired to be in the range of 5-200 μm.

The fixation belt 1 is stretched around no less than two belt supporting members. Thus, the fixation belt is forced to conform to the curvature of each belt supporting member. This curvature is desired to be no less than 5 mm, preferably, 8 mm, in radius, for the following reason. That is, the fixation belt 1 has the metallic substrate layer. Therefore, if the fixation belt 1 is forced to conform to a curvature, the radius of which is no more than 5 mm, the problem that the substrate layer of (nickel layer) of the fixation belt 1 cracks with the elapse of time, the problem that the fixation belt 1 increases in the amount of force necessary to rotate it, causing thereby the fixation roller 3 to slip on the fixation belt 1, or the like problem occurs. and/or the like, is likely to occur. Thus, these problems can be prevented by designing the belt supporting members so that the radii of their curvatures are no less than the abovementioned value.

2) Belt Guide 2

Figure 7:
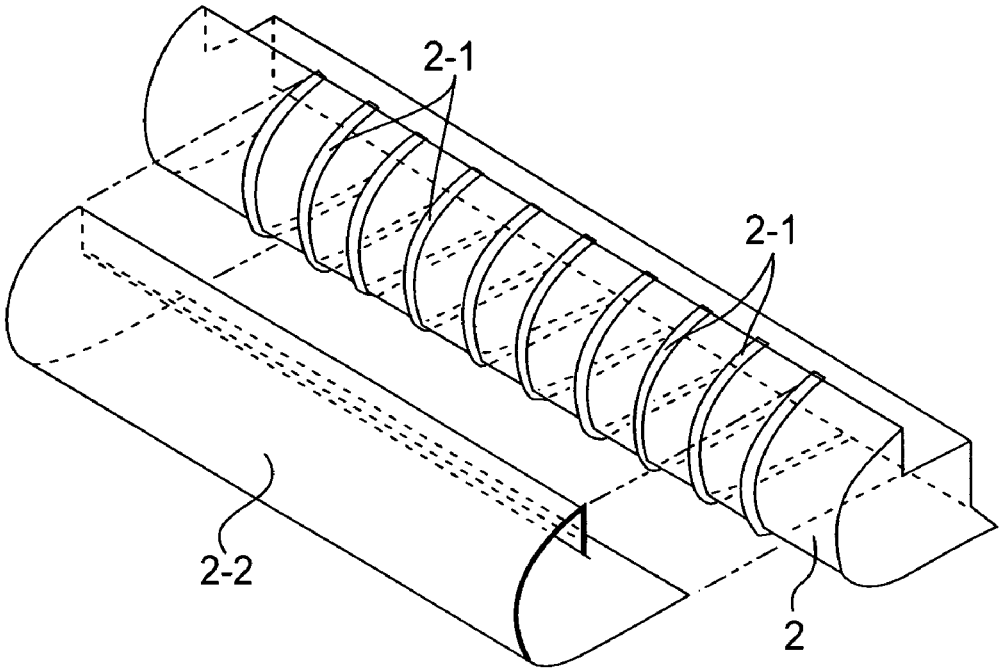
FIG. 7 is an exploded perspective view (1) of the belt guide and belt guide cover.
Figure 8:
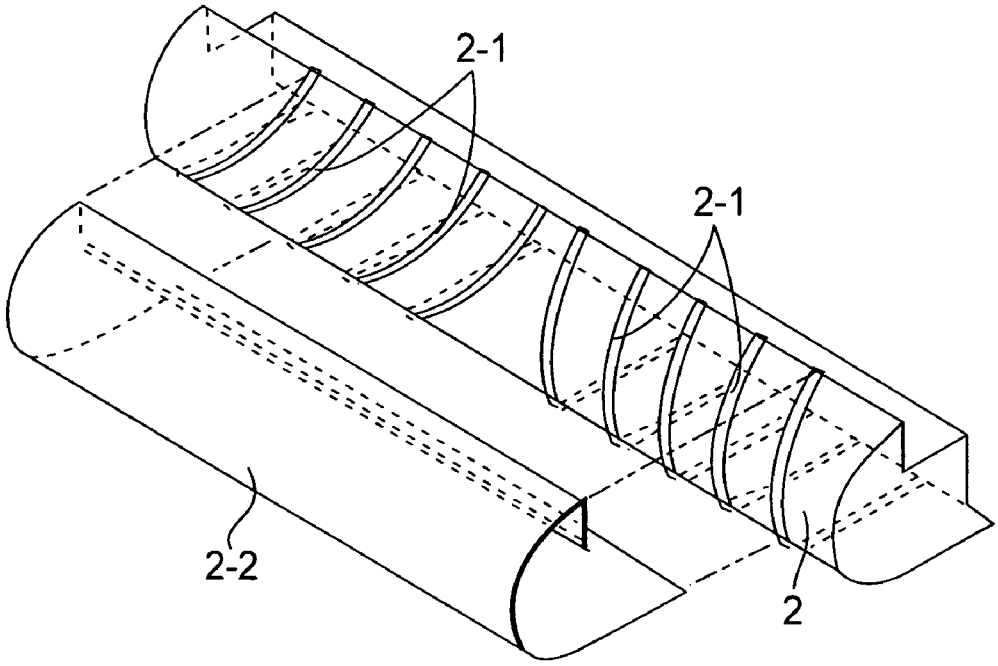
FIG. 8 is an exploded perspective view (2) of the belt guide and belt guide cover.

The belt guide 2 as a belt suspending member is stationarily disposed to guide the fixation belt 1 while allowing the fixation belt 1 to slide thereon. It is formed of resin. In this embodiment, the belt guide 2 is formed of PPS. The belt guide 2 is shaped so that the belt backing portion thereof, around which the fixation belt 1 is wrapped, has a semicircular contour, in a sectional view. In order to minimize the amount by which the pressure in the compression nip N is reduced because of the presence of a gap between the belt guide 2 and fixation roller 3, it is desired that in the compression nip N, the distance between the belt guide 2 and fixation roller 3 is as small as possible. FIG. 7 is an schematic external perspective view of the belt guide 2. As described above, the belt guide 2 also functions as a belt tensioning member; it provides the fixation belt 1 with 49 N (5 kgf) of tension. The belt backing surface of the belt guide 2 is provided with multiple ribs 2-1, which are disposed in parallel and extend in the direction of the fixation belt movement, as shown in FIG. 7. The ribs 2-1 are provided to reduce the frictional resistance between the belt guide 2 and fixation belt 1 by reducing in size the contact area between the belt guide 2 and fixation belt 1, and also, to keep the temperature of only the fixation belt 1 at a high level, by reducing the amount by which heat is conducted from the heated fixation belt 1 to the belt guide 2, by reducing in size the contact area between the belt guide 2 and fixation belt 1. Incidentally, in order to prevent the fixation belt 1 from becoming nonuniform in temperature distribution as it comes into contact with the ribs 2-1, the ribs 2-1 may be disposed at a certain angle relative to the moving direction of the fixation belt 1, as shown in FIG. 8, to ensure that the inward surface of the fixation belt 1 uniformly contacts the ribs 2-1. Further, in order to minimize the amount by which the heat of the fixation belt 1 is conducted to the belt guide 2, it is desired that such resin that is low in thermal conductivity is used as the material for the belt guide 2. Moreover, for the purpose of reducing the frictional resistance between the belt guide 2 and the inward surface of the fixation belt 1, the portion of the belt guide 2, which contacts the inward surface of the fixation belt 1, may be covered with a belt guide cover 2-2 (belt cover sheet), the coefficient of friction between which and the inward surface of the fixation belt 1 is smaller than the coefficient of friction between the fixation belt 1 and the entirety of the ribs 2-1 on the belt guide 2. As the material for the belt guide cover 2-2, glass fiber cloth coated with fluorinated resin, polyimide cloth devised (for example, it is given rough texture for reducing in size the contact area between the belt guide cover 2-2 and fixation belt 1), or the like, may be used. It is to be fixed to the upstream portion of the belt guide 2 in terms of the circular movement of the fixation belt 1. In this embodiment, the former is employed. Further, the inward surface of the fixation belt 1 may be coated with silicone oil or the like to further reduce the frictional resistance between the belt guide cover 2-2 and fixation belt 1.

3) Fixation Roller 3

The fixation roller 3 (rotatable image fixing member) as one of the belt suspending members is 20 mm in external diameter. It is made up of a metallic core 3*a* and an elastic layer 3*b*. The metallic core 3*a* is formed of iron alloy. It is 16 mm in diameter, at the center in terms of its lengthwise direction, and 14 mm in diameter at both of the lengthwise ends. The elastic layer 3*b* is for reducing the fixation roller 3 in thermal conductivity to minimize the amount by which heat is conducted to the fixation roller 3 from the fixation belt 1. It is formed of silicone sponge. The hardness of the fixation roller 3 is roughly 60 degrees (measured by hardness meter based on ASKER-C scale), at the lengthwise center. The reason for tapering the metallic core 3*a* is for ensuring that even if the fixation roller 3 is deformed when pressure is applied thereto, the compression nip N between the fixation roller 3 and pressure roller 4 remains uniform in width, in terms of the lengthwise direction.

The fixation belt 1 is driven by the motor M1 as described above, and is circularly moved by the friction between the surface of the silicone rubber sponge layer of the fixation roller 3 and the polyimide layer (most inward layer) of the fixation belt 1. Thus, in order to circularly drive the fixation belt 1 without allowing the fixation belt 1 and fixation roller 3 to slip on each other, the friction between the inward surface of the fixation belt 1 and fixation roller 3 is desired to be as large as possible.

Further, the friction which occurs as the fixation belt 1 slides on the belt guide 2 is minimized by the belt guide cover 2-2, ensuring that the fixation roller 3 does not slip on the fixation belt 1 as it circularly drives the fixation belt 1.

4) Pressure Roller 4

The pressure roller 4 (rotatable pressure applying member) for forming the fixation nip between itself and the fixation belt 1 is made up of a metallic core 4*a* and an elastic layer 4*b*. The metallic core 4*a* is formed of iron alloy. It is 16 mm in diameter, at the center in terms of its lengthwise direction, and 14 mm in diameter at both of the lengthwise ends. The elastic layer 4*b* is formed of silicone rubber. The pressure roller 4 is also provided with a release layer 4*c* as a surface layer, formed of fluorinated resin (PFA or PTFE, for example) The thickness of the release layer 4*c* is 30 μm. The hardness of the pressure roller 4 is roughly 70 degrees in ASKER-C scale, at the lengthwise center. The reason for tapering the metallic core 4*a* is the same as that for tapering the fixation roller 3, that is, for ensuring that even if the pressure roller 4 is deformed when pressure is applied thereto, the compression nip N between the pressure roller 4 and fixation roller 3 remains uniform in width, in terms of the lengthwise direction. The reason for using silicone rubber, instead of silicone rubber sponge, as the material for the elastic layer 4*b* of the pressure roller 4 is for rendering the pressure roller 4 harder than the fixation roller 3 to cause the fixation belt 1 to substantially bend in the pressure nip N between the fixation belt 1 and pressure roller 4, so that it is easier for the recording medium, on which toner images have been transferred, to separate from the fixation belt 1.

The pressure roller 4 is kept pressed upon the fixation belt 1 by an upwardly pressing means (unshown), which applies 196 N (20 kgf) of pressure. The width of the pressure nip N between the fixation belt 1 and pressure roller 4 in terms of the rotational direction of the peripheral surface 4 is roughly 10 mm.

Figure 9:
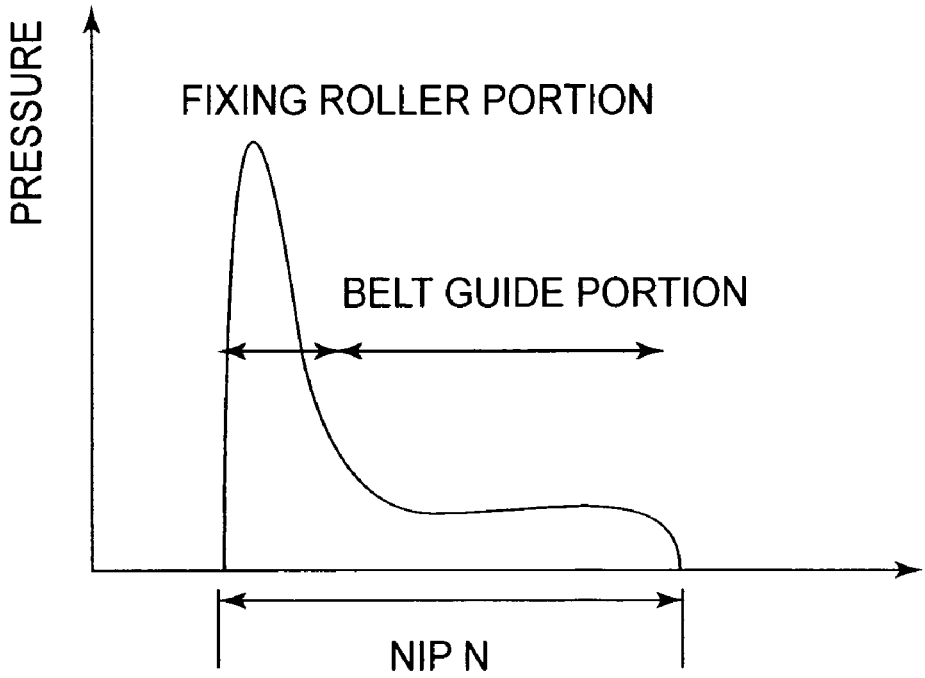
FIG. 9 is a graph showing the pressure distribution in the pressure nip.

In the pressure nip N between the fixation belt 1 and pressure roller 4, there is constant pressure because the pressure roller 4 is kept pressed against the fixation roller 3 and belt supporting member 2. Thus, if there are pressure voids in the pressure nip N, there occur such problems as that the fixation belt 1 and recording medium P separate from each other, and/or the toner image T is disturbed by the difference in velocity between the fixation belt 1 and recording medium P. This embodiment can prevent these problems. FIG. 9 shows the pressure distribution in the pressure nip N in this embodiment.

5) Excitation Unit 7

The fixation belt 1 and the induction coil 5 of the excitation unit 7 are separated in terms of electrical connection from each other, by the 0.5 mm thick molded resin. The gap between the fixation belt 1 and induction coil 5 is rendered uniform at 1.5 mm (distance between surface of molded resin and surface of fixation belt is 1.0 mm), ensuring that the fixation belt 1 is uniformly heated.

The length of the induction coil 5 in terms of the direction parallel to the path width direction of the recording medium is greater than the path width A of the largest recording medium P usable for forming an image with the use of the image forming apparatus in this embodiment. As described above, the high frequency current, which is 20-50 kHz in frequency and is flowed through the induction coil 5 to generate heat in the metallic layer 1*a* of the fixation belt 1 by electromagnetic induction, in order to heat the fixation belt 1. The amount of the electric power inputted into the induction coil 5 is controlled by varying in frequency the high frequency current, based on the temperature value of the fixation belt 1 detected by the first temperature sensor TH1, so that the temperature of the fixation belt 1 remains constant at a target level of 170° C.

As for the thickness of the silicone rubber sponge layer 3*b* of the fixation roller 3 in this embodiment, even the thinnest portion of the layer 3*b* is 2 mm, virtually eliminating the possibility that the metallic core is electromagnetically heated by the induction coil 5. In this embodiment, therefore, only the fixation belt 1 is heated; it is efficiently heated.

Figure 10:
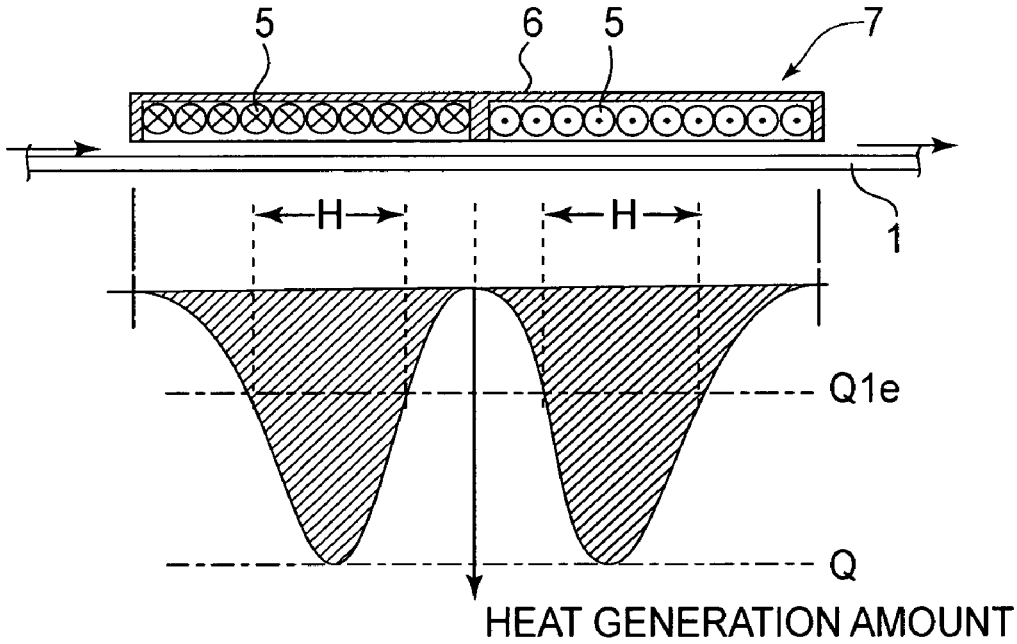
FIG. 10 is a combination of a development of the excitation unit (inductive heating coil) and a graph showing the distribution of the amount of heat generated in the fixation belt, showing the relationship between a given point of the excitation unit and the amount of heat generated in the corresponding point of the heating member.

FIG. 10 shows the heat distribution of the fixation belt 1 across the area (in developmental view) in which the fixation belt 1 directly opposes the excitation unit 7 (induction coil 5).

There two points H and H at which the fixation belt 1 is highest in the amount of heat generation. More specifically, the two points H and H, at which the fixation belt 1 is highest in the amount of heat generation, coincide with the centers of the two halves (in terms of circular movement of fixation roller) of the induction coil 5, one for one, shown in FIG. 2 (one is where temperature sensors TH1 and TH2 are positioned in drawing, and the other is where fixation roller 3 is in drawing).

The temperature sensors TH1 and TH2 are attached to the belt guide 2, being placed in contact with the inward surface of the fixation belt 1, at the points which are greatest in the amount of the heat generation by the fixation belt 1. With the temperature sensors TH1 and TH2 positioned as in this embodiment, the temperature of the fixation belt 1 can be detected at the points which are greatest in the amount of the heat generation in the fixation belt 1. Therefore, it is possible to extremely accurately and quickly detect that the temperature of the fixation belt has risen to an abnormal level for some reason. In other words, it is possible to detect as soon as possible that the fixation belt 1 is abnormal in temperature. Therefore, it is possible to quickly interrupt the electric power supply to the coil 5 (if it happens to be during an image formation job, job itself is interrupted as well). Thus, it is possible to prevent the fixing apparatus (fixation belt) from being damaged. Further, as the anomaly in the fixation belt temperature is detected, the control circuit 100 outputs a signal for displaying the message stating that the image forming apparatus, in particular, the fixing apparatus, is in an abnormal condition, on the liquid crystal display of the control panel of the image forming apparatus, in order to prompt an operator to repair the apparatus.

Incidentally, when the image forming apparatus is connected, as a part of an LAN, with a host computer such as a personal computer through a communication cable, and functions as a printer, the control circuit 100 outputs to the personal computer, a signal for notifying the personal computer that the image forming apparatus (fixing apparatus) is in an abnormal condition.

The excitation unit 7 which includes the induction coil 5 is disposed outside the loop of the fixation belt 1, instead of inside the loop of the fixation belt 1, where temperature becomes higher. Therefore, the temperature of the excitation coil 5 is unlikely to become excessively high, offering the advantage of allowing the usage of inexpensive heat resistant substance as the material for the coil 5. Also because the temperature of the induction coil 5 does not become excessively high, there is the advantage that the induction coil 5 does not increase in electrical resistance, and therefore, the amount of the loss attributable to the generation of Joule heat, which occurs as high frequency current is flowed through the induction coil 5, is smaller. Obviously, the positioning of the induction coil 5 outside the loop of the fixation belt 1 contributes to reducing the fixation belt 1 in diameter (hence, reducing fixation belt 1 in thermal capacity).

The pressure roller 4 can be pressed upon the fixation belt 1, or separated from the fixation belt 1, by the a shifting mechanism 1020 (FIG. 2) made up of a cam mechanism or the like connected to a motor. The control circuit 100 controls this shift mechanism 1020 to keep the pressure roller 4 separated from the fixation belt 1, against the pressure from the above-mentioned upwardly pressing means, except for during an image fixing operation. With the pressure roller 4 kept separated from the fixation belt 1, the heat generated in the fixation belt 1 does not conduct to the pressure roller 4, reducing thereby the fixing apparatus A in warmup time. More specifically, with the fixation belt 1 remaining separated from the pressure roller 4, it takes only roughly 15 seconds for the fixing apparatus A to warm up to the target temperature level of 170° C., as 1,200 W, for example, of electric power is inputted into the induction coil 5.

Further, the circularly movable fixation belt 1 is under a relatively small amount of pressure. Therefore, the force which acts in the direction to cause the fixation belt 1 to deviate in its widthwise direction while the fixation belt 1 is circularly moved is relatively small. In other words, the force which acts in the direction to shift the fixation belt 1 in its widthwise direction is small. Therefore, all that is necessary as a means to be provided for regulating the shifting of the fixation belt 1 in its widthwise direction is a pair of flanges 3*c* for simply catching the fixation belt 1 by the edge portions one for one. In other words, this embodiment of the present invention offers the advantage of making it possible to simplify in structure the fixing apparatus A.

In the above, a fixing apparatus structure in which the fixation belt is suspended by the fixation roller and belt guide was described. However, it is possible to employ a roller instead of the belt guide. Suspending the fixation belt by two rollers instead of the combination of one roller and one belt guide is advantageous in that it is smaller in the amount of torque required to circularly move the fixation belt. On the other hand, suspending the fixation roller by two rollers requires to place a stay (supporting plate), to which temperature detecting means are attached, within the loop of the fixation belt, and therefore, the fixation belt has to be increased in diameter. Thus, the structural arrangement in which the belt guide is employed, and the temperature detecting means are attached to the belt guide, is advantageous in that it makes it possible to reduce the fixation belt in diameter, making it thereby possible to reduce the fixing apparatus in size, further reducing thereby the fixing apparatus in thermal capacity, reducing thereby the fixing apparatus in warmup time.

As described above, in this embodiment, the fixing apparatus A was reduced in size by placing the excitation unit 7 which includes the induction coil 5, outside the loop of the fixation belt 1, making it thereby possible to reduce in size the fixing apparatus (hence, image forming apparatus). Also in this embodiment, the fixation belt 1 was supported by the fixation roller 3, and the stationary belt guide 2 which doubled as one of the pressure applying members in the pressure nip N. Therefore, it was possible to reduce the amount of heat wasted due to thermal conduction while heating the fixation belt 1, which was small in diameter and thermal capacity. Therefore, it was possible to reduce the fixing apparatus (image forming apparatus) in warmup time. Moreover, in this embodiment, the friction which occurred as the fixation belt 1 slid on the ribs 2-1, with which the belt guide 2 was provided, was reduced by placing the belt guide cover 2-2 between the ribs 2-1 and fixation belt 1, and the fixation belt 1 was driven by the fixation roller 3. Therefore, it was ensured that the fixation roller 3 did not slip on the fixation belt 1 while circularly moving the fixation belt 1. Also in this embodiment, the temperature of the fixation belt 1 was detected by the thermistors to detect the anomaly in the fixation belt temperature, and it was made possible to interrupt the power supply to the coil according to the results of the temperature detection. However, the structural arrangement for interrupting the power supply to the coil does not need to be limited to the one in this embodiment. For example, instead of the temperature detection elements, a thermo-switch, a thermal fuse, or the like, which deforms or melts as it is subjected to an excessive amount of heat, may be employed to interrupt the power supply to the coil. In other words, the power supply to the coil may be interrupted by hardware alone.

Embodiment 2

Figure 18:
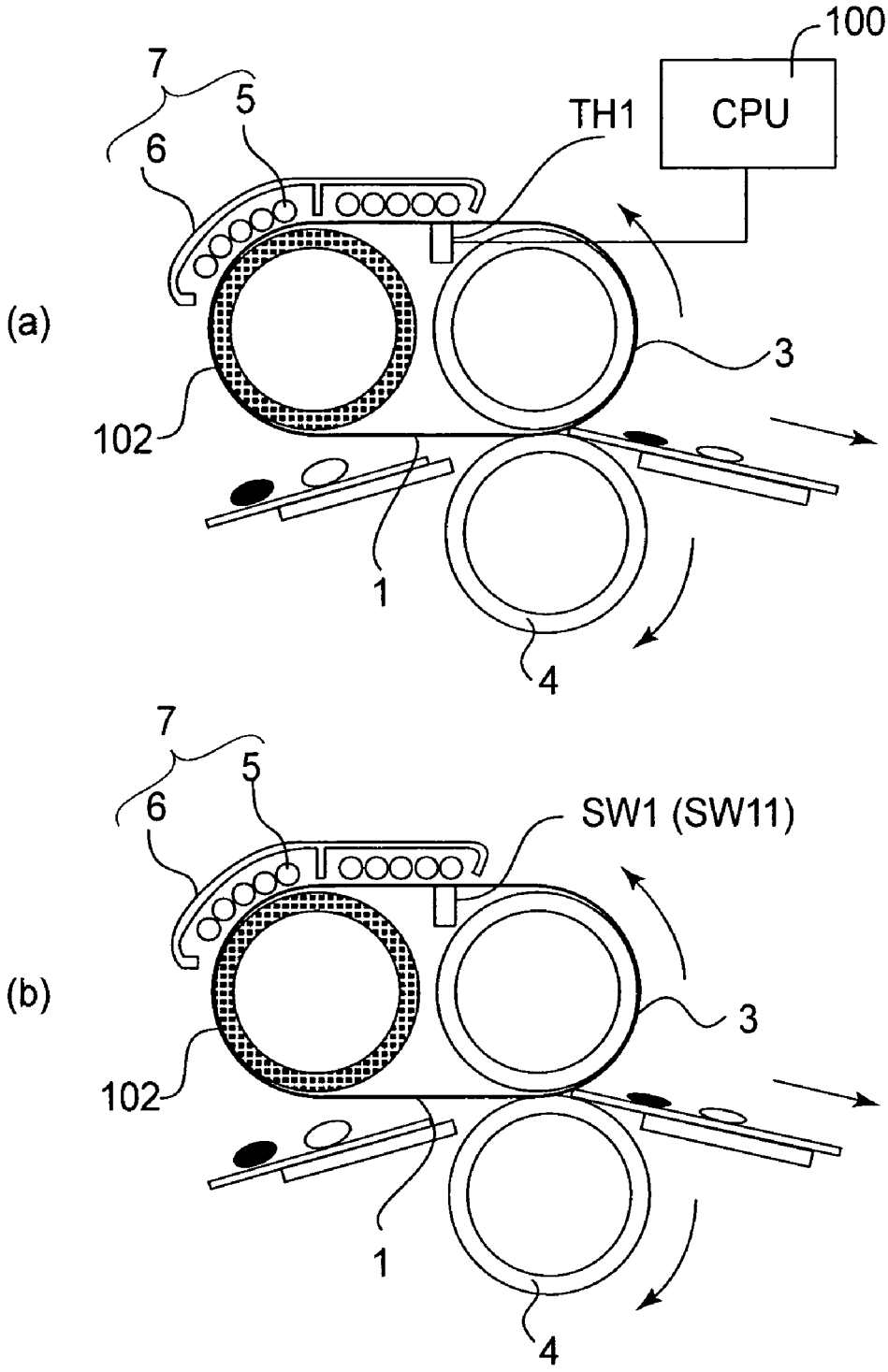
FIGS. 18(*a*) and 18(*b*) are sectional views of the fixing apparatus in the second embodiment.

FIG. 18 is a sectional view of the fixing apparatus A, as an image heating apparatus, in this embodiment. Incidentally, the structure of the fixing apparatus A in this embodiment is basically the same as that in the first embodiment, except for one portion which will be described later. Obviously, the structure of the image forming apparatus in this embodiment is the same as that in the first embodiment. Thus, when a referential symbol assigned to a given component in the drawings for the second embodiment is the same as the one assigned to a component in the first embodiment, the two components are the same in structure as well as function, unless specifically noted.

The fixing apparatus in this embodiment is different from the fixing apparatus A in the first embodiment in that the belt guide 2 in the first embodiment was replaced with a hollow heat generating roller, in the wall of which heat is electromagnetically generated by the magnetic flux from a coil. The heat generating roller 102 is formed of iron. It is 20 mm in diameter and 1 mm in wall thickness. The fixing apparatus in this embodiment is designed so that not only is heat generated in the fixation belt itself, but also, the heat generating roller 102 as a belt suspending member is heated also by electromagnetic induction, making the temperature of the fixation belt reach a preset fixation temperature level faster. In other words, this embodiment offers the advantage of improving in thermal responsiveness the fixing belt used for fixation of the image formed on recording medium.

Further, in this embodiment, the fixing apparatus is designed so that the portion of the magnetic flux, which leaks through the fixation belt, is efficiently utilized to generate heat in the belt suspending roller, more quickly increasing in temperature the belt suspending roller which is rather large in thermal capacity. Therefore, it is possible to reduce the fixing apparatus in warmup time.

Incidentally, in the case in which a pressure pad is disposed within the loop of the fixation belt 1 to form the fixation nip, a 10-50 μm thick resin layer as a friction reducing layer may be formed of fluorinated resin or polyimide, on the inward surface of the substrate layer of the fixation belt, in order to reduce the friction between this pressure pad and fixation belt 1. In this embodiment, the pressure pad is not provided, and therefore, the fixation belt 1 is not provided with the resinous friction reducing layer.

In the case in which the heat generating roller 102 and fixation roller 3, which the inward surface of the fixation belt 1 contacts, are electrically conductive, the inward surface of the substrate layer of the fixation belt 1 is desired to be covered with a dielectric layer to ensure that eddy current is properly induced in the substrate layer (metallic layer) of the fixation belt 1.

In this embodiment, the fixing apparatus is structured so that the fixation belt 1 itself is made to generate heat by the function of the magnetic flux from the excitation coil 5. Therefore, it is higher in thermal responsiveness, being therefore advantageous in that it is shorter in warmup time.

Figure 19:
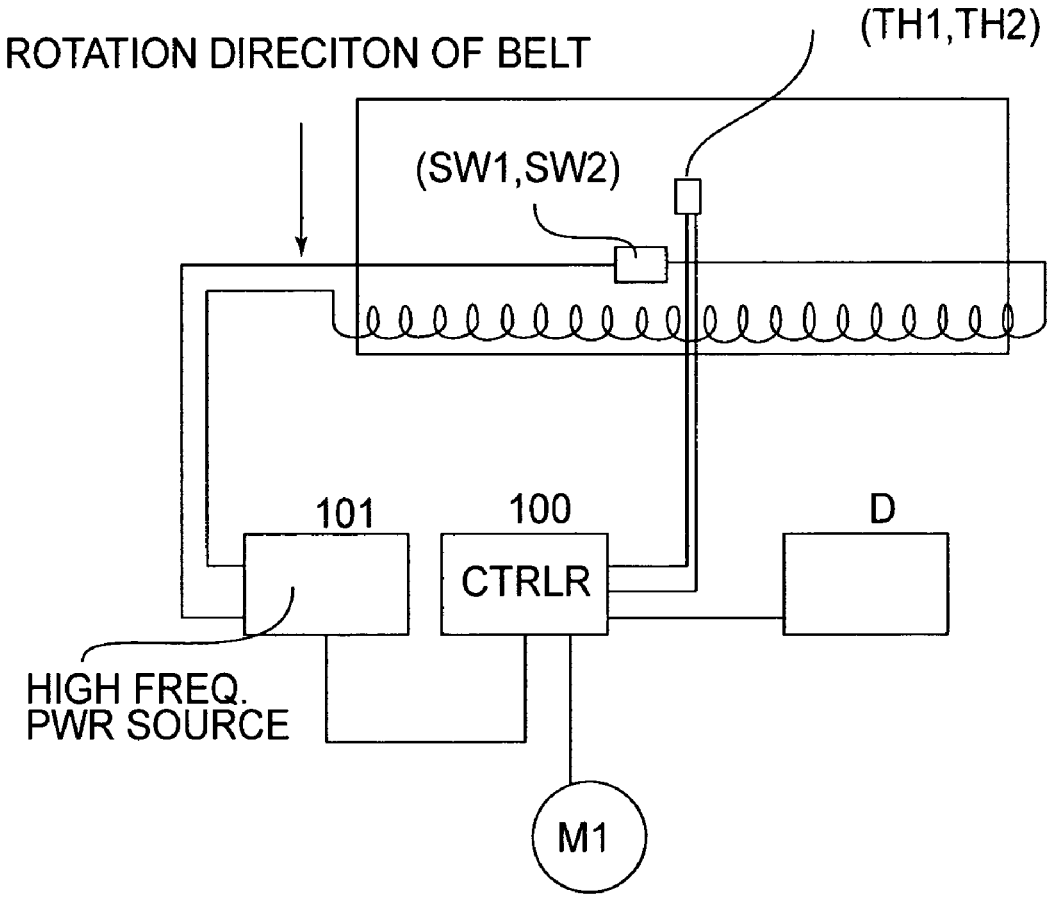
FIG. 19 is a block diagram of the control system of a fixing apparatus.

FIG. 19 is a block diagram of the control system in this embodiment. A temperature sensor TH1 (thermistor) as a power supply interruption element (temperature detection element) is disposed so that it directly contacts the inward surface of the fixation belt 1, in the area in which heat is generated in the fixation belt 1. The temperature sensor TH1 is connected with a control circuit 100.

With the temperature sensor TH1 disposed as in this embodiment, the portion of the fixation belt, the temperature of which is detected, is such a portion of the fixation belt that is in the area, in which heat is generated in the fixation belt by the excitation coil 5, and also, that is not in contact with the fixation roller 3 and is small in thermal capacity (when belt is stationary). Therefore, the belt temperature can be detected at a high level of responsiveness.

The control circuit 100 as a power supply controlling means is structured so that it controls the amount by which electric power is supplied to the excitation coil 5, according to the results of the detection of the fixation belt temperature by the temperature sensor TH1. In other words, the control circuit 100 controls the amount by which electric power is inputted into the excitation coil 5.

The control circuit 100 is also connected to a motor M1 for driving the fixation belt, and begins to supply the excitation coil 5 with electric power, in response to its reception of a signal, from the motor M1, indicating that the motor M1 is normally rotating. However, should the gear train between the motor M1 and fixation roller 3 break down, it is possible that the fixation belt 1 will stop circularly moving, even though the motor M1 is normally rotating.

More specifically, as for the method used by the control circuit 100 to keep the temperature of the fixation belt 1 close to the preset fixation temperature of 170° C. according to the temperature level of the fixation belt 1 detected by the temperature sensor TH1, the image forming apparatus (fixing apparatus) is structured so that the high frequency current supplied to the excitation coil 5 from the power source 101 is varied in frequency by the control circuit 100, or the like arrangement is made.

At least while an image is actually formed, the fixation belt 1 is circularly moved by the motor M1 in the direction (clockwise direction) indicated by an arrow mark in FIG. 18, at a preset peripheral velocity, which is roughly the same as the velocity at which the recording medium P bearing an unfixed toner image is conveyed to the fixing apparatus from the secondary transfer portion.

In this embodiment, the fixing apparatus is designed so that the fixation belt 1 is circularly moved at a peripheral velocity of 160 mm/sec, enabling thereby the fixing apparatus to process 40 full-color copies of A4 size per minute.

While the recording medium P bearing an unfixed toner image is moved through the fixation nip, the temperature of which is kept close to the preset fixation temperature level, heat is applied to the recording medium P and the unfixed image thereon, by the fixation belt 1, while pressure is applied thereto from the pressure roller. As a result, the unfixed toner image is fixed to the recording medium P. During this process, the recording medium P is introduced into the fixation nip so that the surface of the recording medium P, which bears the toner image, contacts the fixation belt 1.

Next, the safety measures for the fixing apparatus in this embodiment will be described. These safety measures are for properly dealing with a situation in which the power supply to the excitation coil 5 goes out of control because of some apparatus anomaly. In this embodiment, the fixing apparatus (image forming apparatus) is designed so that even the worst situation, for example, the situation that the power supply to the excitation coil 5 goes out of control even though the circular movement of the fixation belt has stopped, can be properly dealt with. With the employment of the structural arrangement in this embodiment, should the situation that the power supply to the excitation coil 5 go out of control occur, the power supply to the excitation coil 5 is interrupted even while an image is actually being formed.

In this embodiment, first, as the primary safety measure, a safety measure based on software, which involves the temperature sensor TH1 and the control portion 100 as a means for interrupting power supply is employed, as shown in FIG. 18(*a*). More specifically, the fixing apparatus (image forming apparatus) is structured so that as the temperature of the fixation belt, which is detected by a temperature sensor 107, as a temperature detection element, used for controlling the temperature of the fixation belt 1, reaches an abnormal level (200° C., for example), the control portion 100 as the power supply interrupting means responds to the situation; it interrupts the power supply to the excitation coil.

Here, the abnormal temperature level means a temperature level higher than the temperature levels expected to be detected by the temperature sensor during a normal fixation operation. As the abnormal temperature level is detected, the fixing apparatus A is immediately stopped by interrupting the power supply thereto, and the image forming operation, which is being carried out by the image forming apparatus, is stopped (if an image is being formed, operation is interrupted). In this embodiment, the fixation temperature level as the target temperature level is set to 170° C. The abnormal temperature level is set to 200° C. in consideration of the fluctuation of the fixation belt temperature, which occurs even during a normal fixing operation.

In this embodiment, as the above described situation occurs, an "error" message is displayed by the control portion 100, on the control panel D (liquid crystal display), with which the top portion of the image forming apparatus is provided. Seeing this message, an operator is to recognize the occurrence of the anomaly, and call a service person if necessary.

In the case in which the image forming apparatus is used as the printer for a LAN, and is in connection with a personal computer, as a host computer, through a LAN cable, the control portion 100 sends the "error" message to the personal computer through the network.

More specifically, the control portion 100 sends to the personal computer a control signal so that the "error" message is displayed on a monitor connected to the personal computer.

Incidentally, the "error" message may be replaced, as fits, with another message as long as its contents can convey to an operator that the problem has occurred.

In this embodiment, the temperature sensor TH1 is disposed in the adjacencies of the area in which heat is generated in the fixation belt 1, as is a thermo-switch, which will be described later. In other words, the temperature of the fixation belt 1 is detected at a point in the area in which the fixation belt 1 is faster in thermal responsiveness, and therefore, the anomaly in the fixation belt temperature can be quickly detected, making it possible to interrupt the power supply to the excitation coil 5 before the fixation belt 1 is thermally damaged.

As the secondary safety measure, a safety measure based on a hardware is employed; a thermo-switch SW1 as an element for interrupting the power supply to the excitation coil 5 regardless of the temperature of the fixation belt 1 detected by the temperature sensor TH1 is employed, as shown in FIG. 18(*b*). More specifically, the fixing apparatus (image forming apparatus) is structured so that as the temperature of the thermo-switch SW1 itself is increased by the abnormal temperature increase of the fixation belt 1, the thermo-switch SW1 interrupts the power supply to the excitation coil. The thermo-switch SW1 is disposed so that it contacts the approximate center portion of the fixation belt 1 in terms of the widthwise direction of the fixation belt 1. In terms of electrical circuitry, it is placed between the power source 101 and excitation coil 5.

The thermo-switch SW1 is made up of a bimetal, which is designed so that it deforms as its temperature reaches a preset level. This deformation is utilized to open the power supply passage of the electrical circuit to interrupt the power supply.

In this embodiment, therefore, the operating temperature of the bimetal, that is, the temperature level at which the bimetal opens the circuit, is set to 200° C.; it is designed so that as the temperature of the fixation belt 1 increases to 200° C. due to the failure in controlling the power supply to the excitation coil 5, the bimetal opens the power supply circuit.

With the employment of the above described thermo-switch, should the control portion 100 or temperature sensor TH1 fail, the power supply to the excitation coil 5 can be instantly interrupted as soon as the temperature of the fixation belt 1 reaches the operating temperature of the bimetal.

Incidentally, in this embodiment, a thermo-switch is employed as the element for interrupting the power supply to the excitation coil 5. However, it is possible to use a thermal fuse SW11 instead of a thermo-switch. The thermal fuse SW11 is designed so that as its temperature reaches a preset level, it melts to create a physical gap in the circuitry, that is, opens the power supply circuit as does the thermo-switch, stopping thereby the power supply to the excitation coil 5. In this specifications of the present invention, all the thermal phenomenons that occur as the temperature of a thermo-switch or thermal fuse SW11 such as those described above reaches a preset operating temperature will be hereafter referred to as "thermal deformation of power supply interruption element".

This embodiment is characterized by the location of the above described temperature sensor TH1 or thermo-switch. Next, the characteristics of the safety measure in this embodiment will be described with reference to a case in which the thermo-switch SW1 is employed. Incidentally, the employment of the temperature sensor TH1 instead of the thermo-switch SW1 does not affect the characteristics of the safety measure in this embodiment.

As described above, as the power supply to the excitation coil 5 goes out of control for some reason, for example, an anomaly in an apparatus, the temperature of the fixation belt 1 is likely to rise to an abnormal level (portions of fixation belt, which are not in contact with rollers 2 and 3, more quickly increase in temperature). It was also stated that it is while the fixation belt 1 is not circularly moved that these phenomenons occur.

Also as described above, in this embodiment, in order to reduce the length of time it takes for the fixation belt 1 to reach a desired temperature level, an attempt is made to reduce in thermal capacity (thickness) the fixation belt 1 of the fixing apparatus A. On the other hand, in order to prevent the fluctuation (temperature drop) in the temperature of the fixation belt 1, which occurs as heat is robbed from the fixation roller 1 by the recording mediums while multiple copies are continuously made, the rollers for guiding the fixation belt 1 are given a proper amount of thermal capacity for preventing the fluctuation.

With the provision of the above described structural arrangement, a certain portion of the magnetic flux generated by the excitation coil 5 leaks inward of the loop of the fixation belt 1 though the fixation belt 1. Thus, in this embodiment, an attempt is made to utilize this leaking portion of the magnetic flux to increase the magnetic flux in power factor. That is, by structuring the fixing apparatus so that the portion of the magnetic flux, which otherwise will leak through the fixation belt 1, is efficiently utilized to generate heat in the roller 3 itself, the roller 3 which is relatively large in thermal capacity can be increased faster in temperature. Therefore, not only can the temperature drop which occurs to the fixation belt 1 while multiple copies are continuously made, be minimized, but also, the fixing apparatus can be reduced in warmup time.

The employment of the above described structural arrangement requires that if the power supply to the excitation coil 5 goes out of control while the fixation belt is not circularly moved, a countermeasure therefor is taken before the fixation belt is thermally damaged.

In this embodiment, therefore, the thermo-switch SW1 is placed in contact with the portion of the inward surface of the fixation belt 1, which is in the area in which heat is generated in the fixation belt 1 (while belt is not rotated), that is, the area in which the thermo-switch opposes the excitation coil 5, with the presence of the fixation belt 1 between the thermo-switch SW1 and excitation coil 5, as shown in FIG. 18(*b*).

In other word, the excitation coil 5 is disposed so that it extends from the area in which it opposes the heat generating roller 102 with the presence of the fixation belt 1 between the excitation roller 5 and heat generating roller 102, to the area in which it opposes the thermo-switch SW1 with the presence of the fixation belt 1 between the excitation roller 5 and thermo-switch SW1. Incidentally, the excitation coil 5 in this embodiment is made up of a single wound piece of Litz wire.

In the area in which the thermo-switch SW1 is in contact with the fixation belt 1 (while fixation belt is not rotated), heat is generated only in the fixation belt 1, which is smaller in thermal capacity. Therefore, the rate at which the temperature of the portion of the fixation belt 1 in this area increases is very high. This is why it is desired that the thermo-switch SW1 is disposed as described above, in consideration of the operational safety regarding the period in which the fixation belt 1 is not rotated. In other words, the thermo-switch SW1 is desired to be disposed as described above so that the power supply to the excitation coil can be interrupted before the fixation belt 1 is thermally damaged.

It is possible to place the thermo-switch in contact with the internal surface of the heat generating roller 102 (on the side closer to excitation coil in terms of circumferential direction of roller). However, this placement reduces the thermo-switch in thermal responsiveness, failing thereby to prevent the thermal damage to the fixation belt 1.

It is also possible to place the thermo-switch between the excitation coil 5 and the outward surface of the fixation belt 1. However, for the following reason, this placement cannot be said to be desirable.

That is, placing the thermo-switch SW1 in this location requires a space therefor, increasing therefore the distance between the excitation coil 5 and fixation belt 1. Therefore, it reduces the efficiency with which the magnetic flux from the excitation coil 5 acts on the fixation belt 1.

As described above, with the employment of the structural arrangement in this embodiment, even if the power supply to the excitation coil 5 goes out of control while the fixation belt 1 is not rotated, it is possible to quickly use a proper countermeasure; it is possible to prevent the fixation belt 1 from sustaining the thermal damages.

Described above was an example of the structural arrangement in which the thermal switch SW1 is placed in contact with the inward surface of the fixation belt 1. However, where and how the thermo-switch SW1 is placed does not need to be limited to the above described example; the thermo-switch SW may be placed in the hollow of the roller 2 (as close as possible to excitation coil, that is, in the area which is as high as possible in thermal responsiveness), being therefore not in contact with the fixation belt 1. In this embodiment, in order to satisfy the above described requirements regarding the positional relationship between the thermo-switch SW1 and fixation belt 1, the thermo-switch SW1 is disposed so that the distance between the thermo-switch SW1 and the inward surface of the fixation belt 1 is no more than 500 μm, in consideration of the thickness of the wall of the heat generating roller 102, which is 1 mm. Incidentally, the distance between the thermo-switch SW1 and fixation belt 1 does not need to be limited to the value in the abovementioned range. From the standpoint of thermal responsiveness, it is preferable that the thermo-switch SW1 is placed in contact with the inward surface of the fixation belt 1.

Also in the above, an example of the structural arrangement in which the excitation coil 5 is made up of a single piece of Litz wire (multiple pieces of finer wire bound to each other by being twisted together). However, the configuration of the excitation coil 5 does not need to be limited to the above described one. For example, two excitation coils, each of which is made up of its own piece of Litz wire; a first excitation coil is positioned so that it opposes the heat generating roller 102, with the presence of the fixation belt 1 between them, and a second excitation coil is positioned so that it opposes the thermo-switch SW1 with the presence of the fixation belt 1 between the two. In such a case, it is desired that the fixing apparatus (image forming apparatus) is designed so that as an anomaly occur, both the power supply to the first excitation coil and the power supply to the second excitation coil are interrupted together by the above described safety mechanism made up of the temperature sensor TH1 or thermo-switch SW1.

Also in this embodiment described above, the members which guide the fixation belt 1 from the inward side of the fixation roller loop were the heat generating roller 102 and fixation roller 3. However, they do not need to be limited to these two rollers. For example, instead of the heat generating roller 102 and fixation roller 3, two or more virtually stationary guiding members (during an image fixing operation) may be placed within the loop of the fixation belt 1 to guide the fixation belt 1 from within the fixation roller loop.

Embodiment 3

Figure 20:
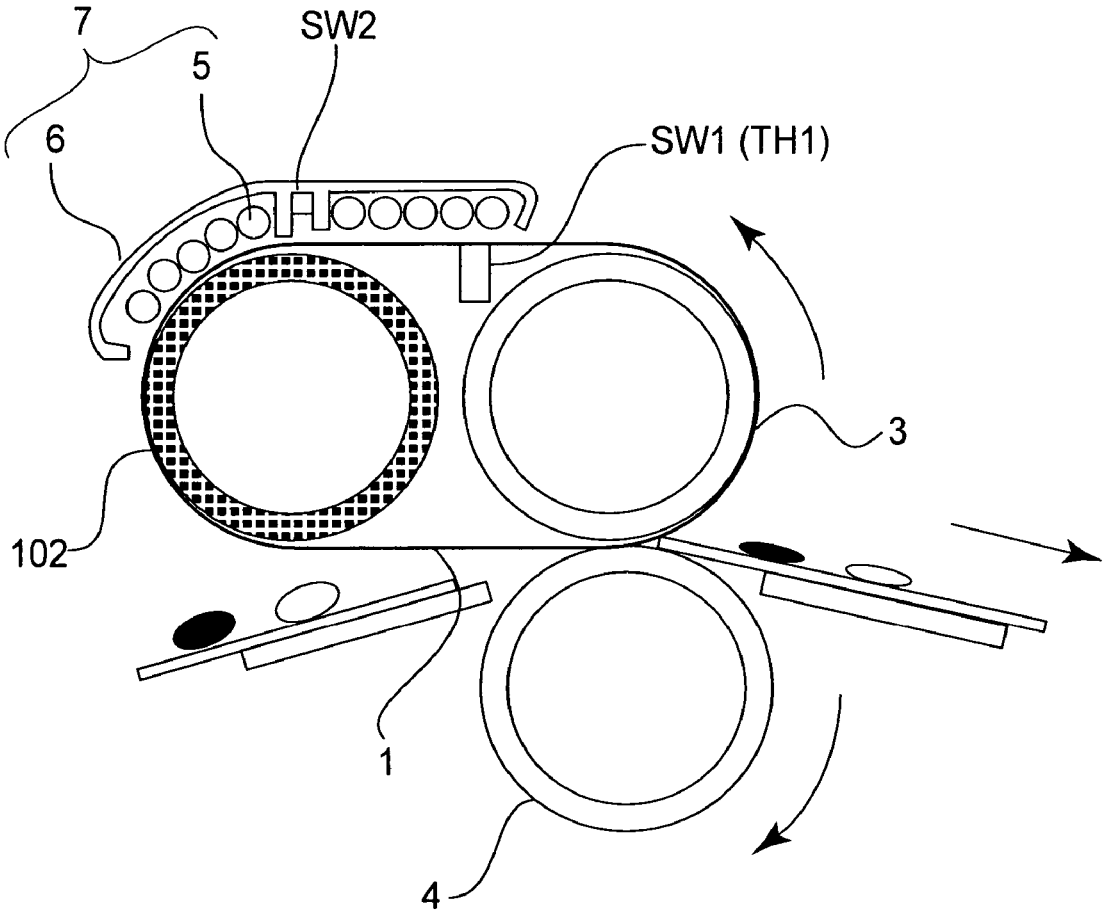
FIG. 20 is a sectional view of the fixing apparatus in the third embodiment.

Next, referring to FIG. 20, the third embodiment of the present invention will be described. The fixing apparatus in this embodiment is the same in basic structure as those in the first and second embodiments, except for the portions which will be described later. Therefore, the structure of the fixing apparatus in this embodiment will not be described in detail, except for the exceptional portions. Obviously, the structure of the image forming apparatus in this embodiment is the same as those in the first embodiment, and therefore, will not be described in detail.

This embodiment is such an embodiment of the present invention that is intended to provide a fixing apparatus (image forming apparatus) which properly responds even if the fixation belt 1 partially or completely breaks. It is characterized in that the fixing apparatus is provided with a thermo-switch SW2 as the power supply interruption element, in addition to the above described thermo-switch SW1 in the first embodiment.

If the fixation belt 1 completely splits, for some reason, in the widthwise direction, the fixation belt 1 will disappear from the area in which the thermo-switch SW1 was in contact with the fixation belt 1, and in which heat was generated in the fixation belt 1.

Should the power supply to the excitation coil 5 goes out of control in the above described situation, the thermo-switch SW1 does not increase in temperature, and therefore, remains turned off. In other words, the power supply to the excitation coil 5 is not interrupted. Consequently, the fixation belt 1 will sustain thermal damage.

In this embodiment, therefore, the structural arrangement for generating heat in the wall of the heat generating roller 102 is utilized to dispose the thermo-switch SW2 so that it is on the outward side of the fixation belt loop, and also, so that it opposes the heat generating roller 102. The activation temperature of the bimetal of the thermo-switch SW1 in this embodiment is 200° C. as is that of the thermo-switch SW1 in the second embodiment, whereas the activation temperature of the bimetal of the thermo-switch SW2 in this embodiment is set to 170° C., which is lower than that of the thermo-switch SW1, because the thermo-switch SW2 is disposed with no contact between the thermo-belt SW2 and fixation belt 1. Further, the thermo-switch SW2 is disposed so that it opposes the approximate center of the fixation belt 1, as is the thermo-switch SW1, in terms of the widthwise direction of the fixation belt 1.

Therefore, even if the fixation belt 1 completely splits in the widthwise direction, the power supply to the excitation coil 5 is interrupted, because the thermo-switch SW2 increases in temperature even if the fixation belt 1 is not present between the thermo-switch SW2 and heat generating roller 102.

If the thermo-switch SW2 is placed in contact with the outward surface of the fixation belt 1, the surface will possibly sustains damages. Therefore, when the thermo-switch SW2 is placed on the outward side of the fixation roller loop, it is disposed so that there is no contact between the thermo-switch SW2 and the outward surface of the fixation belt 1.

With no contact between the thermo-switch SW2 and fixation belt 1, the response of the thermo-switch SW2 to abnormal temperature increase is slightly delayed. However, this delay does not create a problem, because the heat generating roller 102 is substantially larger in thermal capacity than the fixation belt 1.

Figure 21:
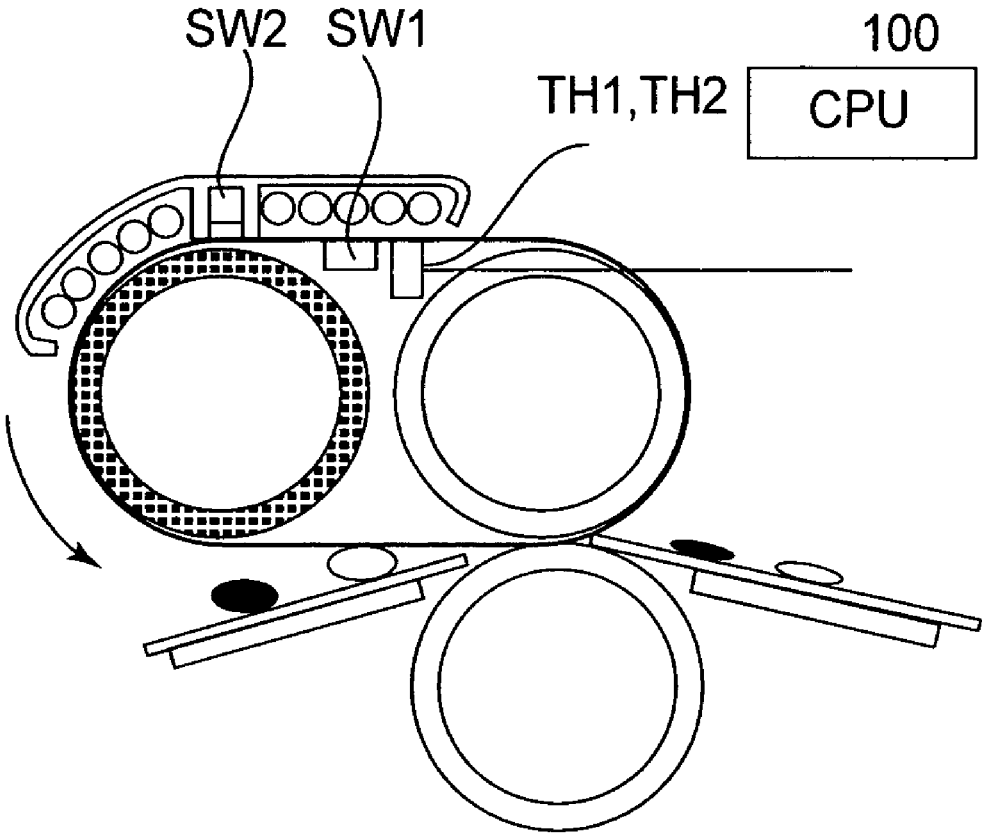
FIG. 21 is also a sectional view of the fixing apparatus in the third embodiment.
Figure 22:
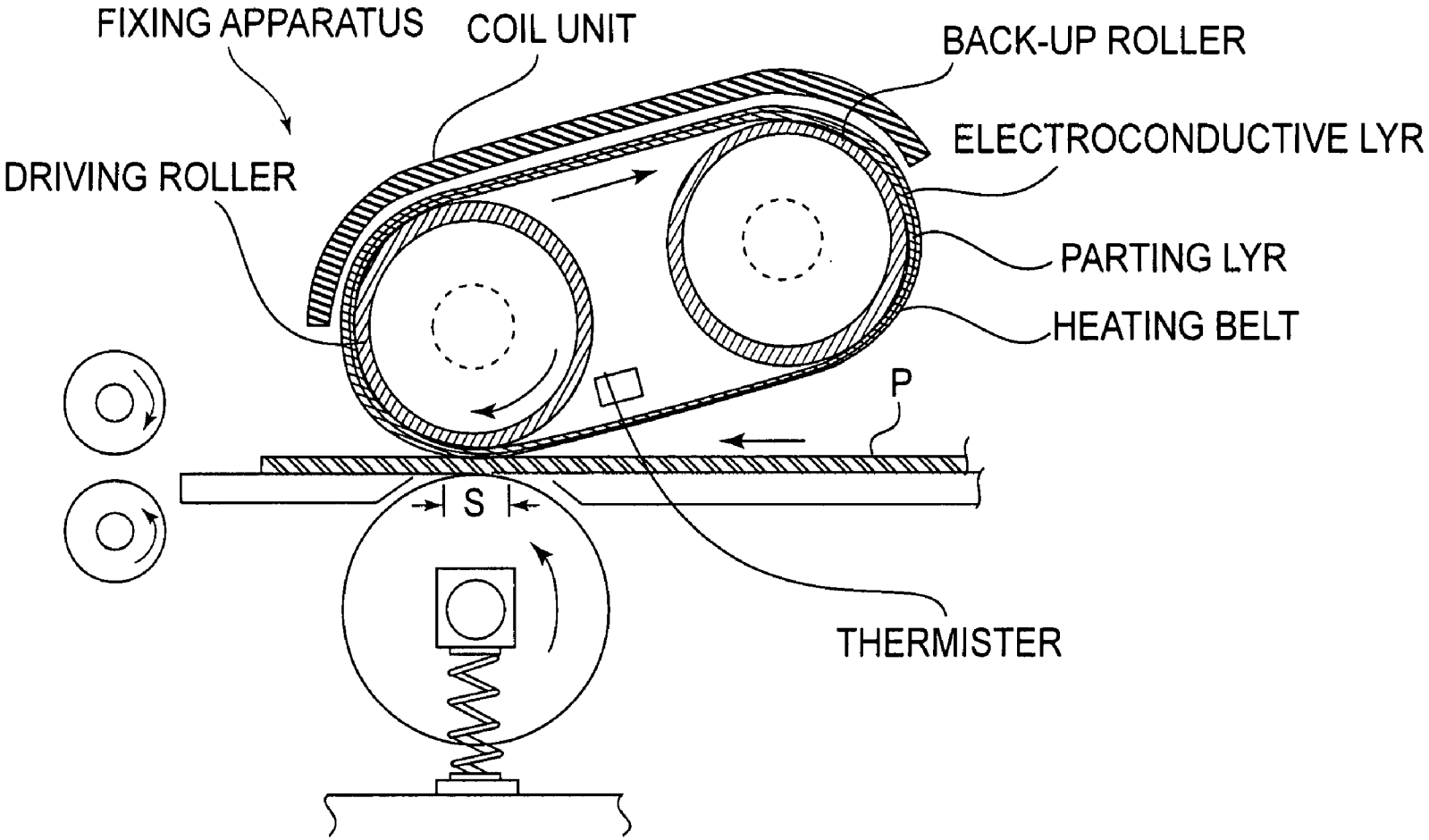
FIG. 22 is a schematic sectional view of a typical fixing apparatus in accordance with the prior art.

FIG. 21 shows the structural arrangement, for a fixing apparatus, in which the second and third embodiments are combined to further improve a fixing apparatus in terms of the safety measures before and after the splitting of the fixation belt 1. More specifically, in FIG. 5, the first thermo-switch SW1 and temperature sensor TH1, which are for preventing the fixation belt 1 from abnormally increasing in temperature, are placed in contact with the portion of the inward surface of the fixation belt 1, which is in the area in which heat is generated in the fixation belt 1. Further, the thermo-switch SW1 is disposed so that it opposes the excitation coil 5 with the presence of the fixation belt 1 between them. Further, the second thermo-switch SW2 for dealing with the widthwise splitting of the fixation belt 1 is disposed so that it is outside the fixation belt loop and opposes the heat generating roller 102. With the employment of the above described structural arrangement, unless the fixation belt 1 completely splits in the widthwise direction, the fixing apparatus is doubly protected by the temperature sensor TH1 and first thermo-switch SW1. Further, should the fixation belt 1 split, the fixing apparatus is still prevented by the second thermo-switch SW from abnormally increasing in temperature.

In this embodiment, the thermo-switches were used as the power supply interruption elements. However, thermal fuses may be employed instead of the thermo-switches, as they were used in the second embodiment.

According to this embodiment described above, even if the fixation belt 1 completely sprits in the widthwise direction, the power supply to the excitation coil 5 is properly interrupted. In other words, this embodiment makes it possible to provide a fixing apparatus which is far safer than a fixing apparatus in accordance with any of the prior arts.

Embodiment 4

Figure 11:
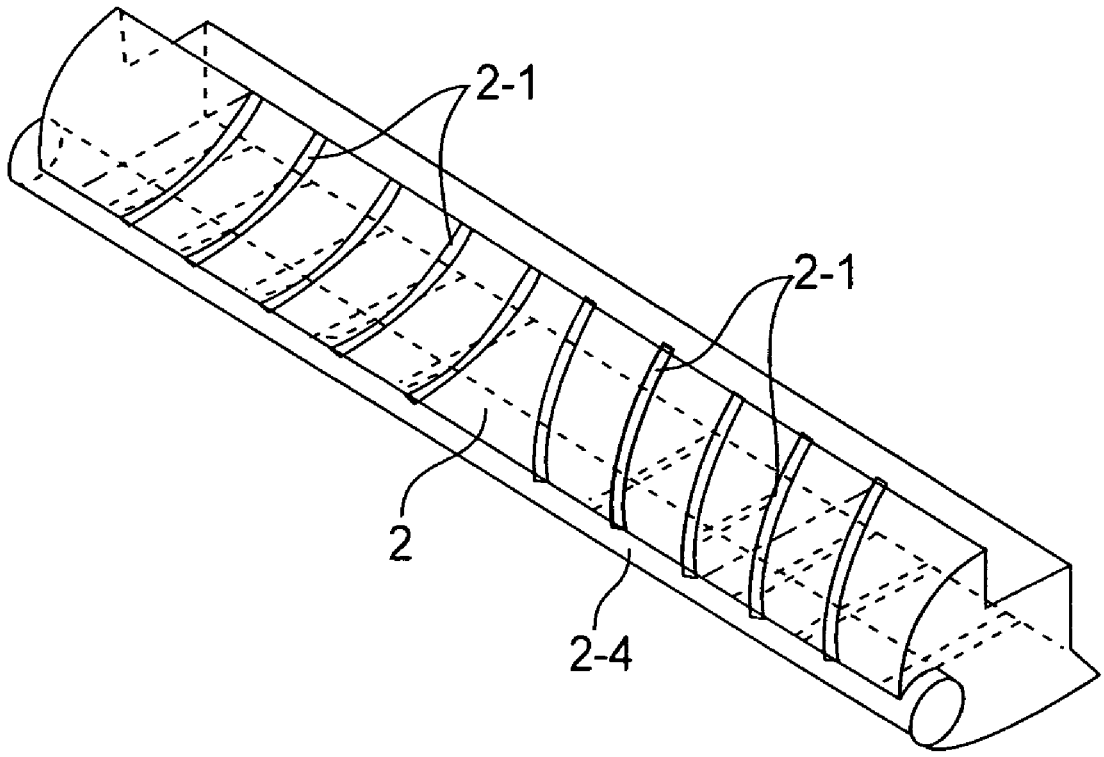
FIG. 11 is an external perspective view of the belt guide in the fourth embodiment of the present invention.

In this embodiment, each of the fixing apparatuses A in the first to third embodiments is provided with a heat pipe 2-4, which is disposed as shown in FIG. 11. In other words, the structures of the fixing apparatuses in this embodiment, except for the provision of the heat pipe 2-4, are the same as that of the fixing apparatus A in the first embodiment, and therefore, will not be described in detail.

A heat pipe is a vacuum-sealed piece of pipe, which contains a small amount of liquid, and the internal surface of which is provided with a capillary structure. As a given part of a heat pipe is heated, the liquid in this heated part of the heat pipe evaporate, and the resultant liquid vapor spreads to the other portions of the heat pipe, which are low in temperature than the heated portion. As a result, the liquid vapor having spread into the low temperature areas of the heat pipe condenses. Then, the resultant liquid is flowed back by capillary action, to where it was heated. In other words, the sealed liquid is continuously re-circulated while being changed in phase. Therefore, a heat pipe is very fast in heat conduction. Thus, a heat pipe is distinctively characterized in that it can conduct a large amount of heat in spite of its small thermal capacity. Therefore, it does not substantially increase the fixing apparatus in warmup time, even though it is placed in in contact with the fixation belt. In this embodiment, when electric power is inputted at a rate of 1,200 W, it takes only 18 seconds for the fixing apparatus to warm up.

The fixation belt 1 is very thin, being therefore low in the lengthwise thermal conduction. Therefore, there has been the problem that as a large number of recording mediums which are narrow in terms of the widthwise direction of the fixation belt 1 are continuously moved, for image fixation, through a fixing apparatus, the portions of the fixation belt 1, which do not come into contact with a recording medium (portions of fixation belt 1 which correspond in position to out-of-path portion C) becomes very high in temperature, because heat is not robbed from these portions of the fixation roller by the recording medium. If the abovementioned portions of the fixation belt 1 become very high, some of the toner particles making up the unfixed image on the recording medium adhere to the portions of the fixation belt 1, which have become very high in temperature (hot offset occurs), resulting in the formation of a defective image.

In this embodiment, therefore, in order to solve this problem, the heat pipe 2-4, which is capable of efficiently conducting heat in the lengthwise direction, and also, is small in thermal capacity, is placed in contact with the surface of the belt guide 2 which is in contact with the inward surface of the fixation belt 1, to make the fixation belt 1 uniform in temperature distribution in terms of the lengthwise direction. Further, in order to reduce the friction between the belt guide 2 and fixation belt 1, the belt guide 2 is provided with ribs 2-1, which are placed on the side by which the belt guide 2 contacts the inward surface of the fixation belt 1, as in the first embodiment. In this embodiment, however, a certain portion of each rib 2-1 is replaced with the heat pipe 2-4, to increase in size the contact area between heat pipe 2-4 and the inward surface of the fixation belt 1. With the heat pipe 2-4 disposed as described above, the heat pipe 2-4 absorbs heat across the lengthwise end portions of the fixation belt 1 (portions of fixation belt 1, which correspond in position to out-of-path area C), which do not come into contact with a recording medium of the small size, and then, conducts the absorbed heat to the center portion of the fixation belt 1 (portion of fixation belt 1, which corresponds in position to path B of recording medium of small size), that is, the area of the fixation belt 1, which comes into contact with the recording medium of the small size.

Figure 12:
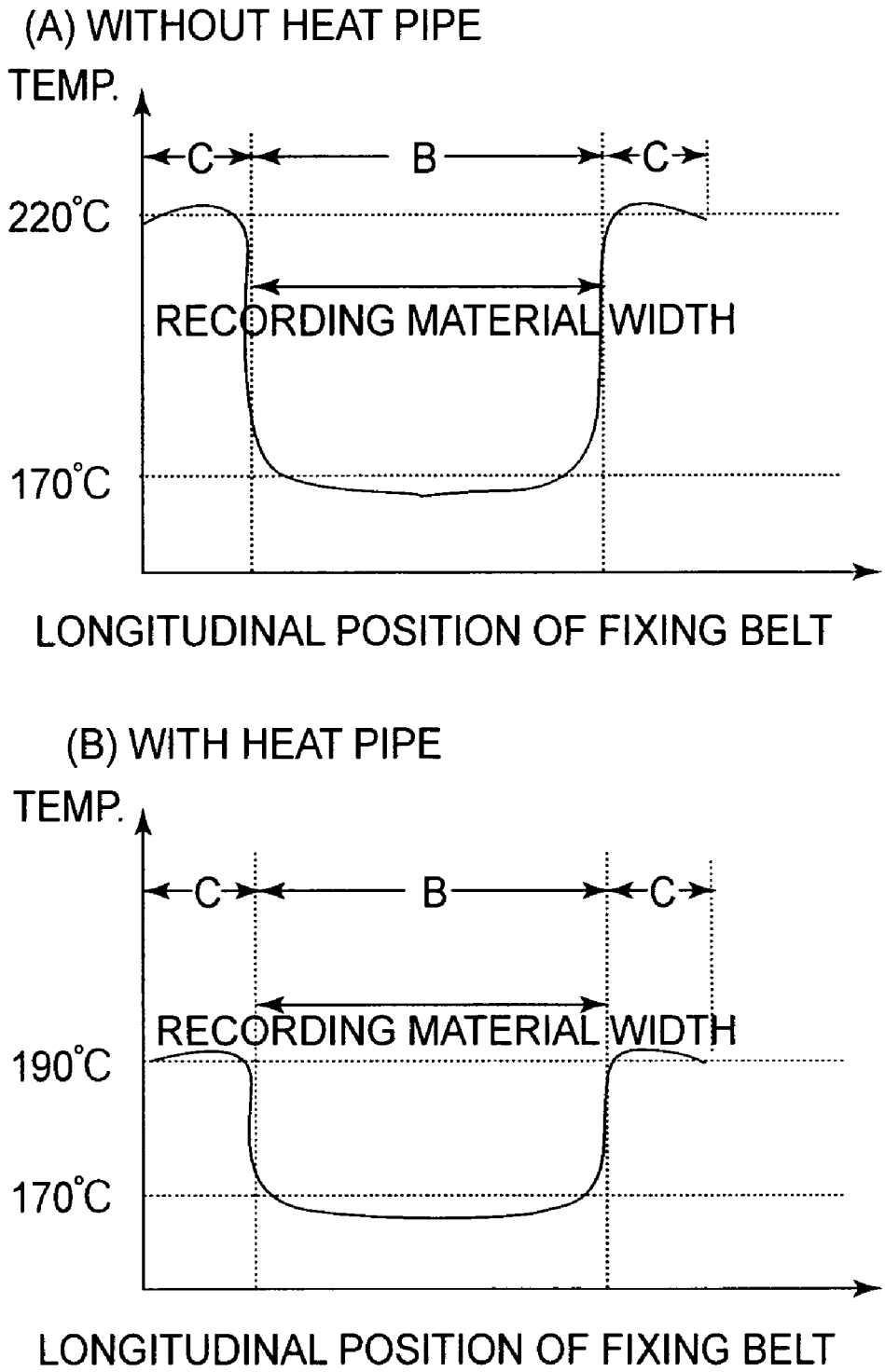
FIG. 12(*a*) is a graph showing the temperature distribution of the fixation belt detected when a belt guide having no heat pipe was employed, and FIG. 12(*b*) is a graph showing the temperature distribution of the fixation belt detected when a belt guide having a heat pipe was employed.

FIG. 12(*a*) shows the heat distribution of the fixation belt 1 immediately after the completion of an image forming operation in which 100 recording mediums of the small size (A4 size) have been continuously conveyed for image fixation, through the fixing apparatus employing a belt guide 2 having no heat pipe 2-4, with the recording mediums positioned so that the long edges of each recording medium is parallel to the recording medium conveyance direction. The portion of the fixation belt 1, which came into contact with the recording mediums (area in recording medium path B) had a temperature of 170° C. which was the target temperature level, whereas the portions of the fixation belt 1 (portions corresponding to out-of-path area C), which did not come into contact with the recording mediums had increased in temperature to 220° C. Immediately thereafter, a recording medium of A4 size was conveyed for fixation through the fixing apparatus, with the recording medium position so that the short edges of the recording medium are parallel to the recording medium conveyance direction. As a result, toner particles adhered to the portions of the fixation belt 1, which were higher in temperature (hot-offset occurred).

FIG. 12(*b*) shows the results of the experiment similar to the above described one, except for the employment of the heat pipe 2-4 by the belt guide 2. In this experiment, the portions of the fixation belt 1 (portion corresponding to out-of-path area C), which did not come into contact with the recording mediums, increased in temperature only to 190° C., which was not high enough to cause the toner particles to adhere to the fixation belt 1 (hot offset did not occur).

As described above, in this embodiment, the belt guide 2 is provided with the heat pipe 2-4. Therefore, in an image forming operation in which a relatively large number of recording mediums of the small size are continuously conveyed through the fixing apparatus, the fixation belt 1 is kept less nonuniform in the temperature distribution in terms of the lengthwise direction than without the heat pipe 2-4. In other words, the fixation belt 1 is reduced in the temperature increase across the portions of the fixation belt 1, which are outside the recording medium path. Further, the warmup time does not substantially increases.

Embodiment 5

In this embodiment, a pressure belt 41 is used in place of the pressure roller 4 in the first embodiment, in order to increase the pressure nip in width by forming the pressure nip between the fixation belt 1 and pressure belt 41, instead of forming the pressure nip between the fixation belt 1 and pressure roller 4, so that the fixation speed can be increased without adversely affecting the merits of the first embodiment.

More specifically, both the heat application side and pressure application side of the fixing apparatus are structured to use a belt. As for the belt supporting members around which the belt is wrapped around to be supported thereby, a stationary guide formed of resin is employed as one of the belt supporting members, instead of a rotatable roller. This guide has a straight portion which extends from the curved portion thereof to the theoretical point where the pressure nip will be. Further, the stationary guide is provided with a pressure pad, which is integrated with the stationary guide.

Figure 13:
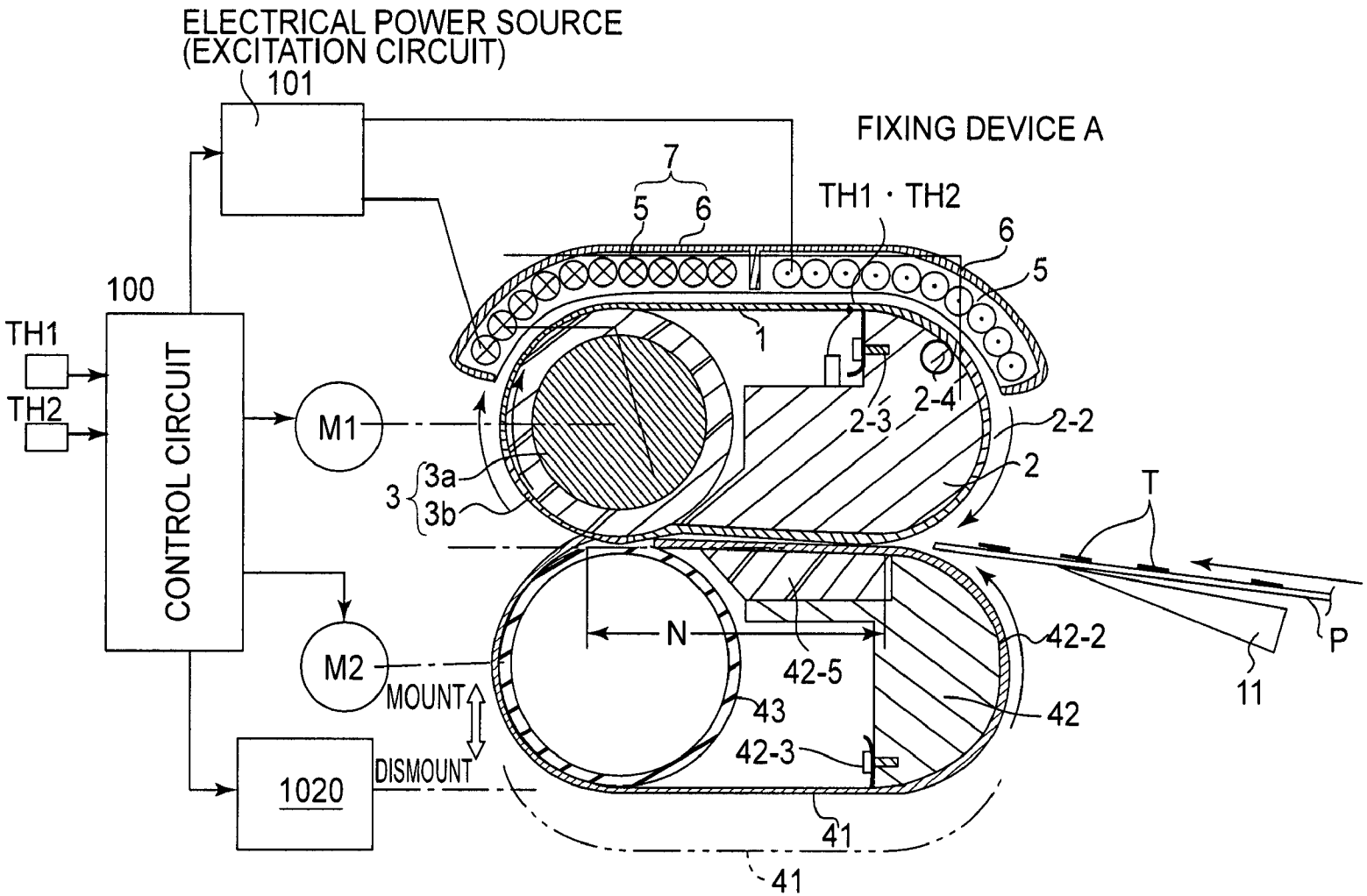
FIG. 13 is a combination of an enlarged sectional view of the essential portions of the fixing apparatus, and a block diagram of the control system, in the fifth embodiment.

FIG. 13 is a combination of a sectional view of the fixing apparatus A, and a block diagram of the control system, in this embodiment. The fixation belt 1, belt guide 2, fixation roller 3, and excitation coil unit 7 of this fixing apparatus are the same in structure as those of the fixing apparatus in the first embodiment, and therefore, will not be described here.

Figure 14:
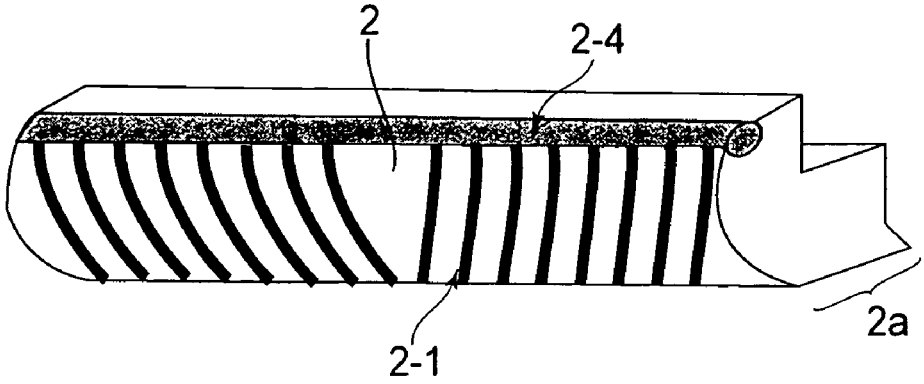
FIG. 14 is an external perspective view of the belt guide on the fixation roller side.

The fixing apparatus in this embodiment is different from the fixing apparatus in the first embodiment in that the belt guide 2 in this embodiment is provided with a heat pipe 2-4, as in the fourth embodiment, to keep the fixation belt 1 as uniform as possible in heat distribution. FIG. 14 is a schematic external perspective view of the belt guide 2, in this embodiment, equipped with a heat pipe 2-4. The portion 2*a* of the belt guide 2 is rendered free of the ribs 2-1, for the following reason. That is, this portion 2*a* of the belt guide 2 corresponds in position to the pressure nip N. Thus, if the ribs 2-1 were extended across the portion 2*a* of the belt guide 2, they would be pressed upon the fixation belt 1 by the belt guide 2, in the pressure nip N between the fixation belt 1, and the pressure belt which will be described later.

The pressure belt 41 is an elastic endless belt, and is made up of a substrate layer formed of polyimide (resinous substrate layer), and a release layer, as the surface layer, formed of fluorinated resin. The substrate layer is 34 mm in internal diameter, and 75 μm in thickness. The release layer is in the form of a tube, and is 30 μm in thickness. In order to minimize the pressure belt 41 in the friction against the belt guide 42 which will be described later, it is desired that the substrate layer contains microscopic particles of fluorinated resin; microscopic particles of fluorinated resin are to be dispersed in the polyimide as the material for the substrate layer. The pressure belt 41 is supported by the belt guide 42 and pressure roller 43.

Figure 15:
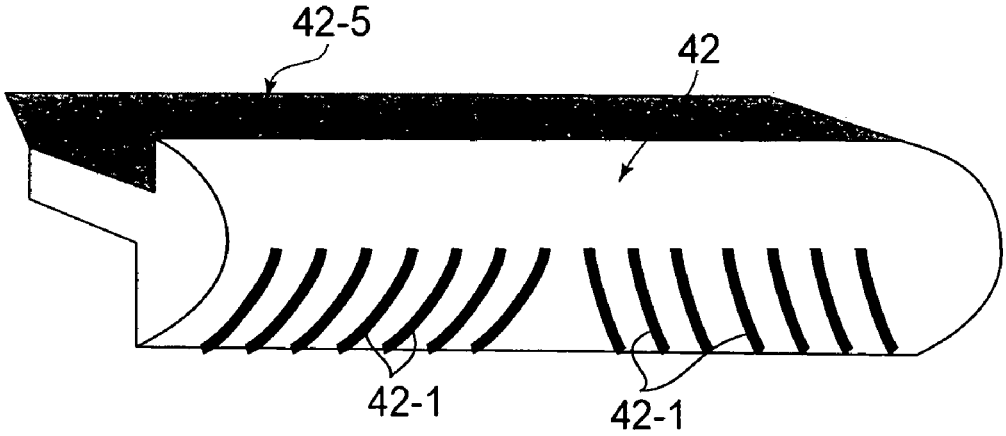
FIG. 15 is an external perspective view of the belt guide on the pressure roller side.
Figure 17:
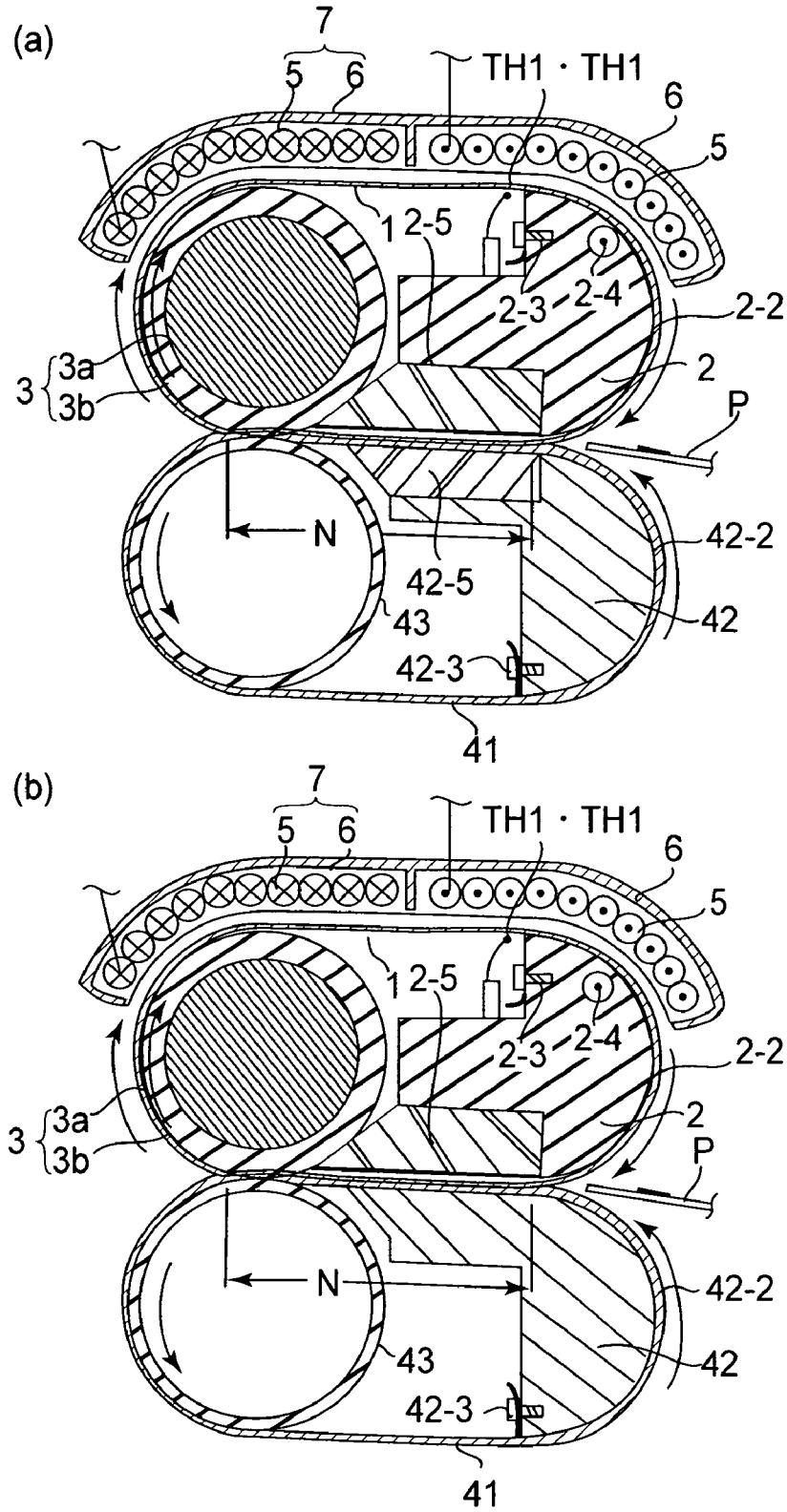
FIGS. 17(*a*) and 17(*b*) are enlarged sectional views of the essential portions of the two fixing apparatuses in fifth embodiment, which are different in structure.

The belt guide 42 is formed of resin; in this embodiment, it is formed of PPS. FIG. 15 is a schematic external perspective view of the belt guide 42. The belt guide 42 is required to double as a belt tensioning member, which provides the pressure belt 41 with 49 N (5 kgf) of tension. The portion of the belt guide 42, which contacts the inward surface of the pressure belt 41, is provided with ribs 42-1. The ribs 42-1 are provided to reduce the friction between the belt guide 42 and pressure belt 41 by reducing in size the contact area between the belt guide 42 and pressure belt 41. However, the portion of the belt guide 42, which corresponds in position to the compression nip N between the fixation belt 1 and pressure belt 41 is rendered free of the ribs, because if this portion of the belt guide 42 were provided with the ribs, the ribs would be pressed by the belt guide 42. In order to reduce the belt guide 42 in the friction against the inward surface of the pressure belt 41, the fixing apparatus may be provided with a belt guide cover 42-2 (FIG. 13) like the belt guide cover 2-2 with which the belt guide 2 on the heat application side is provided. As the material for the belt guide cover 42-2, glass fiber cloth coated with fluorinated resin, polyimide cloth devised (for example, it is given rough texture for reducing in size the contact area between the belt guide cover 42-2 and fixation belt 41), or the like, may be used. It is to be fixed to the upstream portion of the belt guide 42 in terms of the circular movement of the pressure belt 41. In this embodiment, the former is employed. Further, in order to ensure that the fixation belt 1 and pressure belt 41 are tightly pressed against each other in the pressure nip N, it is desired that the portion of the belt guide 42, which corresponds in position to the pressure nip N, is provided with an elastic member 42-5 (pressure pad), which is integrally attached to the belt guide 42. In this embodiment, a piece of silicone rubber is employed as the elastic member 42-5. Also in this embodiment, only the belt guide on the pressure applying side is provided with the elastic member 42-5. However, the belt guide 2 on the heat applying side may also be provided with an elastic member 2-5, as shown in FIG. 17(*a*). Further, it may be only the belt guide 2 that is provided with an elastic member (elastic member 2-5), as shown in FIG. 17(*b*).

The pressure roller 43 is made up of a metallic core, and a 0.3 mm thick silicone rubber layer placed on the peripheral surface of the metallic core. The metallic core is formed of iron alloy. It is 20 mm in diameter, and 1.0 mm in wall thickness. The pressure belt 41 is rotated (circularly moved) by the rotation of the pressure roller 43. More specifically, the pressure roller 43 is driven by a motor M2 controlled by a control circuit 100, and the pressure belt 41 is rotated by the friction between the surface of the silicone rubber layer of the pressure roller 43, and the polyimide layer of the pressure belt 41. The abovementioned provision of the belt guide cover 42-2 reduces the friction between the belt guide 42 and the pressure belt 41.

The belt guide 42 is kept pressed toward the belt guide 2 by a pressure applying means (unshown) which applies 90 N (10 kgf) of pressure to the belt guide 42. The pressure roller 43 is kept pressed toward the fixation roller 3 by a pressure applying means (unshown) which applies 294 N (30 kgf) of pressure to the pressure roller 43. As a result, a pressure nip N, which is roughly 20 mm in width, in terms of the belt movement direction, is formed between the fixation belt 1 and pressure belt 41. In other words, the fixation nip N of the fixing apparatus in this embodiment is wider, being therefore faster in the fixation speed, than that of the fixing apparatus in the first embodiment. Further, in the pressure nip N, the pressure per unit area between the fixation roller 3 and pressure roller 43 is higher than the pressure per unit area between the belt guide 2 and belt guide 42. Therefore, by independently driving the belt 1 and 41 by the fixation roller 3, that is, the roller on the top side, and pressure roller 43, that is, the roller on the bottom side, respectively, it can be ensured that both the belts 1 and 41 rotate without slipping. Further, the pressure roller 43 is harder than the fixation roller 3. Therefore, the fixation roller 3 is greater in the deformation which occurs to the two rollers at the exit of the pressure nip N between the fixation belt 1 and pressure belt 41, than the pressure roller 43, causing therefore the fixation belt 1 to substantially deform at the exit of the pressure nip N. Therefore, it is ensured that the toner image on the recording medium cleanly separates from the fixation belt 1, allowing the recording medium to smoothly separate from the fixation belt 1 to be conveyed further.

Figure 16:
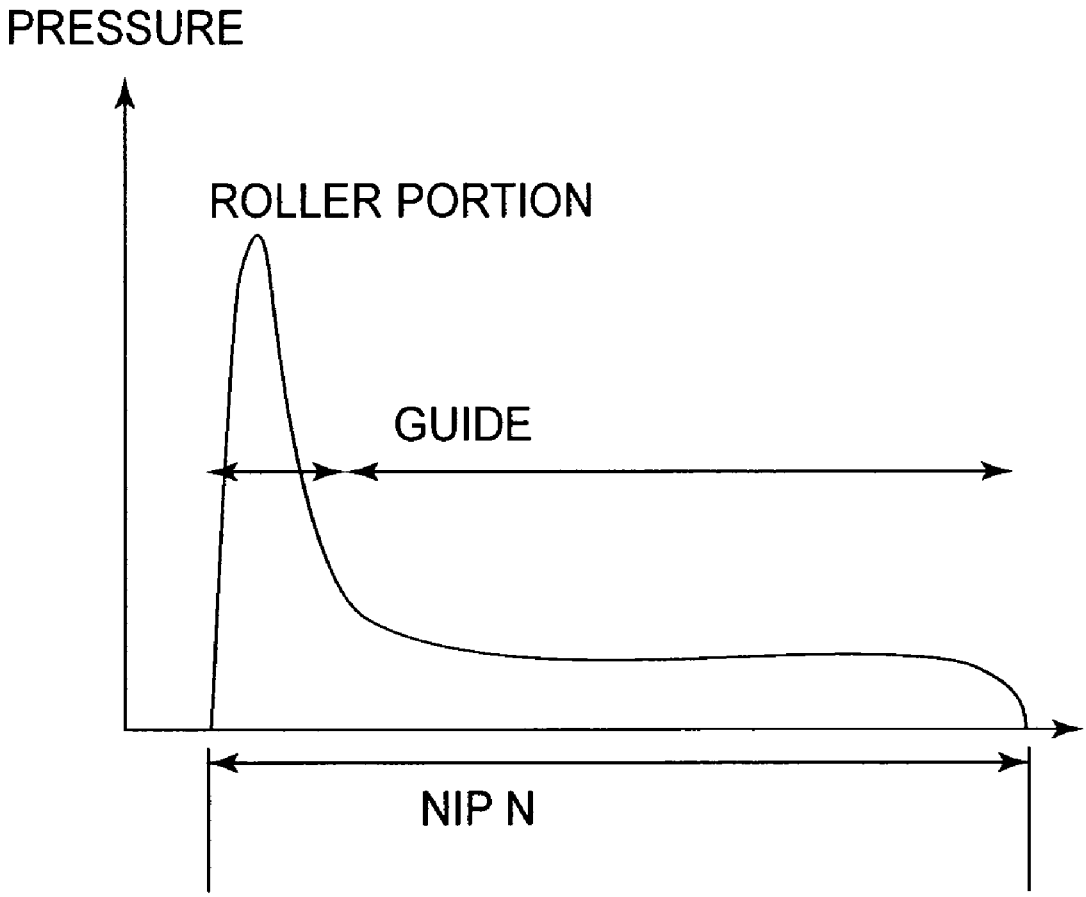
FIG. 16 is a graph showing the pressure distribution of the pressure nip.

Referring to FIG. 16, the belt guides 2 and 42, that is, the top and bottom belt guides, respectively, are shaped and positioned so that they extend close to the fixation roller 3 and pressure roller 43, respectively. Therefore, there is virtually no pressure void in the pressure nip N. If a pressure void is present in the pressure nip N, the problem that the fixation belt 1 and recording medium P become separated from each other, the problem that the toner image T becomes disturbed due to the difference in speed between the fixation belt 1 and recording medium P, and/or the like, may occur. This embodiment prevents the occurrence of these problems.

At least while an image is actually formed, the fixation roller 3 is rotationally driven by a driving means M1, whereby the fixation belt 1 is circularly driven by the fixation roller 3, in the direction indicated by an arrow mark in FIG. 13, at a preset peripheral velocity, which is virtually the same velocity at which the recording medium P bearing an unfixed toner image T is conveyed toward the fixation belt 1 from the image transfer portion. Similarly, at least while an image is actually formed, the pressure roller 43 is rotationally driven by a driving means M2, whereby the pressure belt 41 is circularly driven, also in the direction indicated by an arrow mark in FIG. 13, at a preset peripheral velocity, which is also virtually the same as the velocity of the recording medium P. Therefore, the two belts 1 and 41 are circularly moved without being wrinkled. In this embodiment, the fixation belt 1 and pressure belt 41 are circularly moved at a peripheral velocity of 300 mm/sec, making it possible for the fixing apparatus to fix 70 full-color copies of A4 size per minute.

After the temperature of the fixation belt 1 is increased to a preset fixation temperature, it is controlled so that it remains close to the preset fixation temperature. While the temperature of the fixation belt 1 is maintained at the preset fixation temperature, the recording medium P bearing an unfixed toner image T is introduced into the fixation nip N, with the image bearing surface of the recording medium P facing the fixation belt 1. Then, the recording medium P is conveyed, along with the fixation belt 1, through the fixation nip N while remaining tightly pressed upon the outward surface of the fixation belt 1. Thus, while the recording medium P is conveyed through the fixation nip N, it is given heat, primarily from the fixation belt 1, and also, is subjected to the compressive pressure of the compression nip N. As a result, the unfixed toner image on the recording medium P is fixed to the surface of the recording medium P by heat and pressure. As the recording medium P is conveyed out of the compression nip N, the recording medium P separates itself from the outward surface of the fixation belt 1 because of the deformation of the surface of the fixation belt 1 which occurs at the exit portion of the fixation nip N. Then, the recording medium P is conveyed out of the fixing apparatus.

The pressure belt unit which includes the pressure belt 41, belt guide 42, and pressure roller 43, can be pressed upon the fixation belt 1, or separated from the fixation belt 1, by the a shifting mechanism 1020 made up of a cam mechanism or the like connected to a motor. The control circuit 100 controls this shifting mechanism 1020 to keep the pressure belt 41 separated from the fixation belt 1, except for during an image fixing operation. With the pressure belt 41 kept separated from the fixation belt 1, the heat of the fixation belt 1 is not conducted to the pressure belt 41, reducing thereby the fixing apparatus A in warmup time. More specifically, with the pressure belt 41 kept separated from the fixation belt 1, it takes only roughly 18 seconds for the fixation belt 1 to warm up to the target temperature level of 170° C., as 1,200 W, for example, of electric power is inputted into the induction coil 5.

Further, the circularly movable fixation belt 1 and pressure belt 41 are pressed upon each other, by a relatively small amount of pressure. Therefore, the force which acts in the direction to cause the fixation belt 1 and pressure belt 41 to deviate in the widthwise direction while the fixation belt 1 is circularly moved is relatively small. In other words, the force which acts in the direction to shift the fixation belt 1 and pressure belt 41 in the widthwise direction is small. Therefore, all that is necessary as a means to be provided for regulating the shifting of the fixation belt 1 and pressure belt 41 in the widthwise direction is a pair of flanges for simply catching the fixation belt 1 and pressure belt 41 by their edge portions. In other words, this embodiment of the present invention offers the advantage of making it possible to simplify in structure the fixing apparatus A.

As described above, in this embodiment, the members used in the preceding embodiments for applying pressure to the fixation roller were replaced with a pressure applying belt unit, increasing thereby the compression nip N in width. Therefore, it became possible to increase the fixing apparatus in fixation speed, and yet, there was virtually no increase in the warmup time. Further, the fixation belt 1 and pressure belt 41 were circularly moved, while remaining sandwiched, by the fixation roller 3 and pressure roller 43, which were kept pressed against each other with the application a relatively high pressure. Therefor, the belts were prevented from slipping.

As for the alignment of recording medium relative to a fixing apparatus (image forming apparatus), each of the apparatuses in the preceding embodiments was structured so that the centerline of recording medium, which is parallel to the recording medium conveyance direction, coincides with the centerline of the apparatus, which is parallel to the recording medium conveyance direction. However, the present invention is also applicable to a fixing apparatus (image forming apparatus) structured so that recording medium is aligned with the apparatus by causing one of the edges of recording medium to coincide with one of the referential lines of the apparatus. The effects of such application are the same as those obtained by the fixing apparatuses in the preceding embodiments.

In the preceding embodiments, the image heating apparatuses were described as fixing apparatuses. However, the application of the present invention is not limited to a fixing apparatus.

For example, an image heating apparatus in accordance with the present invention can also be used as a glossiness increasing apparatus for increasing in glossiness an image having already been temporarily fixed to a recording medium, by heating the image, or a heating apparatus for temporarily fix an image.

While the invention has been described with reference to the structures disclosed herein, it is not confined to the details set forth, and this application is intended to cover such modifications or changes as may come within the purposes of the improvements or the scope of the following claims.

As described above, according to the present invention, even if an image heating apparatus is structured so that an excitation coil straddles the area between one end of the belt loop, where the belt is suspended by one of belt suspending members, and the other end of the belt loop, where the belt is suspended by the other belt suspending member, the abnormal increase of the belt temperature attributable to an anomaly can be suppressed in its early stage. Therefore, the present invention makes it possible to provide an image heating apparatus which is much safer than an image heating apparatus in accordance with any of the prior arts.

This application claims priority from Japanese Patent Applications Nos. 077511/2005 and 265512/2005 filed Mar. 17, 2005 and Sep. 13, 2005, respectively, which are hereby incorporated by reference.

What is claimed is:

1. An image heating apparatus comprising:

an endless belt for heating an image on a recording material;

a plurality of supporting members on which said belt is stretched;

a coil, disposed outside of said belt, for generating heat in said belt by a magnetic flux, said coil being disposed opposed both to a non-contact region of said belt between said supporting members and to at least one of contact regions where said belt is stretched on said supporting members, wherein said non-contact region of said belt and at least one of said contact regions of said belt generate heat using a magnetic flux from said coil; and a temperature detecting member for detecting a temperature of said belt to shut off electric power supply to said coil when a temperature of said belt becomes abnormal;

wherein said temperature detecting member is provided contacted to an inside surface of said belt at said non-contact region that generates the heat using the magnetic flux.

2. An apparatus according to claim 1, wherein at least one of said supporting members opposed to said coil is a heat generation member for generating heat by the magnetic flux which is generated by a coil.

3. An apparatus according to claim 1, wherein said temperature detecting member is contacted to a portion of said belt where the heat generation by the coil is highest.

4. A apparatus according to claim 1, wherein at least one of said supporting members is stationary, said belt is slidable relative to said stationary supporting member, and said temperature detecting member is provided on the stationary supporting member.

5. An apparatus according to claim 1, wherein said supporting members include respective rollers which are rotatable with said belt.

6. An apparatus according to claim 1, further comprising a pressing member for press contacting said belt to form a nip for nipping and feeding the recording material, wherein said non-contact region is disposed downstream of said at least one of said contact regions and upstream of said nip with respect to a peripheral moving direction of said belt.

7. An apparatus according to claim 1, further comprising a rotatable member for forming a nip with said belt.

8. An apparatus according to claim 1, further comprising control means for controlling electric power supply to said coil on the basis of an output of said temperature detecting element.

9. An apparatus according to claim 8, further comprising an electric power supply shut off means for shutting off electric power supply to said coil on the basis of an output of said temperature detecting element.

10. An image heating apparatus comprising:

an endless belt for heating an image on a recording material;

a plurality of supporting members on which said belt is stretched;

a coil, disposed outside of said belt, for generating heat in said belt by a magnetic flux, said coil being disposed opposed both to a non-contact region of said belt between said supporting members and to at least one of contact regions where said belt is stretched on said supporting members, wherein said non-contact region of said belt and at least one of said contact regions of said belt generate heat using a magnetic flux from said coil; and a shut off element for shutting off electric power supply to said coil when a temperature of said belt becomes abnormal;

wherein said shut off element is provided contacted to an inside surface of said belt at said non-contact region that generates the heat using the magnetic flux.

11. An apparatus according to claim 10, wherein at least one of said supporting members opposed to said coil is a heat generation member for generating heat by the magnetic flux which is generated by a coil.

12. An apparatus according to claim 10, wherein said shut off element is contacted to a portion of said belt where the heat generation by the coil is highest.

13. An apparatus according to claim 10, wherein at least one of said supporting members is stationary, said belt is slidable relative to said stationary supporting member, and said shut off element is provided on the stationary supporting member.

14. An apparatus according to claim 10, wherein said supporting members include respective rollers which are rotatable with said belt.

15. An apparatus according to claim 10, further comprising a pressing member for press contacting said belt to form a nip for nipping and feeding the recording material, wherein said non-contact region is downstream of said at least one of said contact regions and upstream of said nip with respect to a peripheral moving direction of said belt.

16. An apparatus according to claim 10, further comprising a rotatable member for forming a nip with said belt.

17. An apparatus according to claim 10, wherein said shut off element is connected in an electric power supply circuit for said coil, and is effective to open the electric power supply circuit by thermal deformation thereof.

18. An apparatus according to claim 10, further comprising a temperature detecting element for detecting a temperature of said belt, wherein said temperature detecting element is disposed in the same region as said shut off element is contacted, and control means for controlling the electric power supply to said coil on the basis of an output of said temperature detecting element.

19. An apparatus according to claim 18, wherein said temperature detecting element and said shut off element are disposed at positions different with respect to a rotational axis direction of said belt.

* * * * *